US011121500B2

(12) United States Patent
Masuda et al.

(10) Patent No.: US 11,121,500 B2
(45) Date of Patent: Sep. 14, 2021

(54) CONNECTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Takeshi Masuda, Yokkaichi (JP); Tomoyuki Sakata, Yokkaichi (JP); Hiromu Otani, Yokkaichi (JP); Takehide Terasawa, Yokkaichi (JP); Keiichi Nakamura, Yokkaichi (JP); Takahiko Saitou, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 49 days.

(21) Appl. No.: 16/621,932

(22) PCT Filed: Jun. 26, 2018

(86) PCT No.: PCT/JP2018/024106
§ 371 (c)(1),
(2) Date: Dec. 12, 2019

(87) PCT Pub. No.: WO2019/012979
PCT Pub. Date: Jan. 17, 2019

(65) Prior Publication Data

US 2021/0151932 A1 May 20, 2021

(30) Foreign Application Priority Data

Jul. 14, 2017 (JP) ..... JP2017-138129

(51) Int. Cl.
*H01R 24/00* (2011.01)
*H01R 13/533* (2006.01)
(Continued)

(52) U.S. Cl.
CPC ..... *H01R 13/533* (2013.01); *H01R 13/41* (2013.01); *H01R 13/6272* (2013.01)

(58) Field of Classification Search
CPC ... H01R 13/533; H01R 13/41; H01R 13/6272
See application file for complete search history.

(56) References Cited

U.S. PATENT DOCUMENTS 5,405,904 A * 4/1995 Ikejiri ..... C08L 77/00 524/394
5,525,073 A * 6/1996 Sampson ..... H02G 15/113 439/521
(Continued)

FOREIGN PATENT DOCUMENTS

JP H08-015003 B2 2/1996
JP 2008-166046 A 7/2008
(Continued)

OTHER PUBLICATIONS

Sep. 4, 2018 International Search Report issued in International Patent Application No. PCT/JP2018/024106.

*Primary Examiner* — Abdullah A Riyami
*Assistant Examiner* — Nelson R. Burgos-Guntin
(74) *Attorney, Agent, or Firm* — Oliff PLC

(57) ABSTRACT

A connector that includes a male connector; and a female connector including a housing to be fit to the male connector along a connecting direction, wherein: a first connector of the male connector and the female connector is fixed with a second connector of the male connector and the female connector connected and, a rigidity k [N/m] satisfies k<360000 when the second connector is distorted at a test
(Continued)

speed of 1 mm/min in a direction intersecting the connecting direction and satisfies $k \geq (2.0 \times 10^7) \times m$, where m [kg] denotes a mass of the second connector.

4 Claims, 43 Drawing Sheets

(51) Int. Cl.
*H01R 13/41* (2006.01)
*H01R 13/627* (2006.01)

(56) References Cited

U.S. PATENT DOCUMENTS

2003/0022544 A1* 1/2003 Hattori ..... H01R 13/6272 439/350
2009/0111312 A1 4/2009 Nakata et al.
2011/0059635 A1* 3/2011 Weiss ..... H01R 13/2421 439/86
2013/0122758 A1* 5/2013 Kim ..... C08L 77/12 439/733.1
2013/0309905 A1* 11/2013 Tanaka ..... C08L 53/025 439/587
2014/0030122 A1* 1/2014 Ozaki ..... H02K 49/108 417/410.1
2014/0329418 A1* 11/2014 Ishikawa ..... H01R 13/2407 439/729
2015/0255906 A1* 9/2015 Shibuya ..... C22C 5/06 439/887
2015/0295333 A1* 10/2015 Shibuya ..... C25D 5/10 439/887
2018/0131123 A1* 5/2018 Kondo ..... H01R 13/521

FOREIGN PATENT DOCUMENTS

JP 4962787 B2 6/2012
JP 5375533 B2 12/2013
JP 2014-139873 A 7/2014
JP 2015-169242 A 9/2015

* cited by examiner

| SAMPLE | RIGIDITY [N/m] | MASS [kg] | RIGIDITY/MASS [N/(kg*m)] | RESONANT FREQENCY [Hz] |
|---|---|---|---|---|
| SAMPLE | 86000 | 0.0060 | $1.4 \times 10^7$ | 1000 |
| SAMPLE | 108000 | 0.0061 | $1.8 \times 10^7$ | 1550 |
| SAMPLE | 261000 | 0.0062 | $4.2 \times 10^7$ | 1900 |
| SAMPLE | 134000 | 0.0068 | $2.0 \times 10^7$ | 1600 |
| SAMPLE | 360000 | 0.0067 | $5.4 \times 10^7$ | 2000 OR HIGHER |
| SAMPLE | 204000 | 0.0055 | $3.7 \times 10^7$ | 1900 |
| SAMPLE | 274000 | 0.0057 | $4.8 \times 10^7$ | 1950 |
| SAMPLE | 47000 | 0.0037 | $1.3 \times 10^7$ | 900 |
| SAMPLE | 233000 | 0.0046 | $5.1 \times 107$ | 2000 OR HIGHER |

FIG. 42

CONNECTOR

BACKGROUND

A technique relating to a connector is disclosed in this specification.

Conventionally, a connector used under an environment requiring vibration resistance is known from Japanese Unexamined Patent Publication No. 2008-166046. This connector includes a female housing and a male housing to be connected to each other. A rattling preventing rib to be squeezed between an outer peripheral surface of a terminal accommodating portion for accommodating a female terminal in the female housing and an inner peripheral surface of a small receptacle open forward in the male housing is provided on either one of the outer peripheral surface and the inner peripheral surface. Since the rigidity of the connector in a state where the both housings are connected is enhanced by the rattling preventing rib, the vibration resistance of the connector is improved.

SUMMARY

However, there has not been enough knowledge as to how much the rigidity of the connector in the state where the both housings are connected should be enhanced to make a relative displacement between the both housings sufficiently small. Conventionally, vibration resistance performance had to be actually measured by experimentally producing a connector and conducting a durability test. Thus, guidelines on the rigidity of a connector to improve the vibration resistance of the connector have been required.

An exemplary aspect of the disclosure provides a connector having an improved vibration resistance.

An exemplary aspect of the disclosure includes a connector with a male connector and a female connector including a housing to be fit to the male connector along a connecting direction, wherein a first connector of the male connector and the female connector is fixed with a second connector of the male connector and the female connector connected, and a rigidity k [N/m] satisfies $k<360000$ when the second connector is distorted at a test speed of 1 mm/min in a direction intersecting the connecting direction and satisfies $k\geq(2.0\times10^7)\times m$, where m [kg] denotes a mass of the second connector.

By the above configuration, a resonant frequency f in the state where the male connector and the female connector are connected can be 1600 Hz or higher, wherefore a sufficient vibration resistance can be obtained for the connector.

Since the rigidity k in the state where the male connector and the female connector are connected is less than 360000 [N/m], exclusive of 360000 [N/m], a reduction in the efficiency of a connecting operation of the male connector and the female connector can be suppressed.

The following modes are preferable as embodiments of the technique disclosed in this specification.

The second connector can be the female connector.

The male connector includes a receptacle to be fit to the housing, a terminal connected to an end of a wire is held in the housing, and the housing includes a lead-out from which the wire connected to the terminal is led out to outside, a protrusion protruding outward to face a tip of the receptacle, an external fitting projecting from the protrusion toward the receptacle to be externally fit to the tip of the receptacle and exposing an outer surface of a base end side of the receptacle, and a reinforcing rib connected to the lead-out and the protrusion.

According to this configuration, since the external fitting of the housing is externally fit to the tip of the receptacle and exposes the outer surface of the base end side of the receptacle, the connector can be reduced in weight as compared to a configuration in which the external fitting is also externally fit to the outer surface of the base end side of the receptacle. Since the resonant frequency changes and the influence of the resonance of the connector can be suppressed if the connector is reduced in weight, it is possible to suppress troubles caused by vibration while reducing manufacturing cost.

Here, if the connector is reduced in weight, the rigidity of the housing decreases and a displacement amount of the connector due to the vibration of the wire increases. Thus, there is a concern for troubles such as sliding wear in a part where the terminals are in contact with each other due to a positional deviation of the terminal or the like. Since the protrusion and the lead-out are connected by the reinforcing rib according to the above configuration, the rigidity of the housing can be enhanced by the reinforcing rib and a displacement of the connector can be suppressed. In this way, a reduction in the rigidity of the housing and troubles due to an increase in the displacement amount of the connector can be suppressed.

According to the technique disclosed in this specification, the vibration resistance of a connector can be improved.

BRIEF DESCRIPTION OF THE DRAWINGS

FIG. 42 is a table compiling experimental results of Samples 1 to 9.

DETAILED DESCRIPTION OF EMBODIMENTS

Summary of Embodiment

Figure 1:
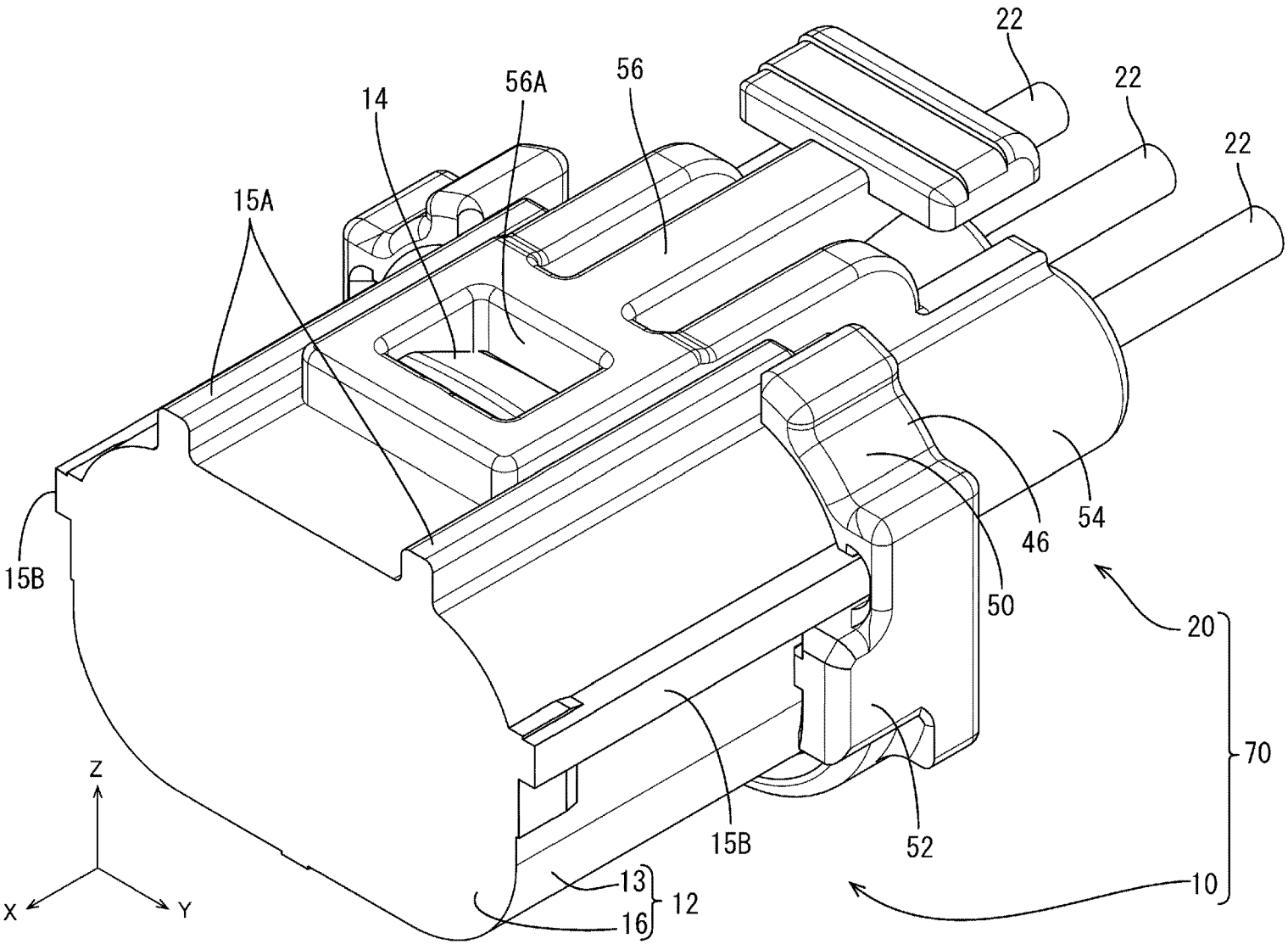
FIG. 1 is a perspective view showing a connector according to one embodiment.

A summary of an embodiment according to the technique disclosed in this specification is described. It is effective as an anti-vibration measure of a connector to suppress a relative displacement between a male connector and a female connector. One such method is thought to be a method for increasing a resonant frequency of the connector and suppressing a relative displacement by enhancing the rigidity of the connector in the state where the male connector and the female connector are connected.

A relationship of a rigidity k of a connector, a resonant frequency f of the connector and a relative displacement x between a male connector and a female connector is described below.

The following relationship holds between the resonant frequency f of the connector and the relative displacement x between the male connector and the female connector when a denotes a vibration acceleration.

$$x=a/(2\pi f)^2 \quad \text{(Equation 1)}$$

Further, the following relationship generally holds between a natural frequency $\omega=2\pi f$, which is a frequency at which resonance occurs, and the rigidity k when m denotes a mass.

$$\omega(k/m)^{1/2} \quad \text{(Equation 2)}$$

With reference to both Equations 1 and 2, it is clear that the natural frequency w increases and the resonant frequency f of the connector also increases if the rigidity k of the connector is enhanced. As a result, the relative displacement x between the male connector and the female connector can be suppressed.

For example, a case is assumed where a very large acceleration of 100 G (100-fold of a gravitational acceleration) is applied to the connector. In this case, if the resonant frequency f of the connector reaches 1600 Hz or higher, the relative displacement x between the male connector and the female connector has a very small value of 1 μm or less. Thus, a sufficient vibration resistance can be obtained.

As a result of the inventors' earnest study, it was revealed that, in order for the resonant frequency f of the connector to reach 1600 Hz or higher, the resonant frequency f of the connector reached 1600 Hz or higher when a relationship of the rigidity k and the mass m of the connector was $k \geq (2.0\times 10^7)\times m$.

The resonant frequency of the connector can be, for example, measured as follows. The male connector including a male receptacle open in a connecting direction and the female connector including a housing to be fit to the male connector are connected along the connecting direction. With the male connector and the female connector connected, the male connector and the female connector are left for a predetermined time in a constant temperature chamber or constant temperature bath regulated to a test temperature until the temperatures of the male connector and the female connector become equal to an ambient temperature. The predetermined time can be, for example, set at about 1 hour. One of the male connector and the female connector is fixed to a connector fixing portion provided on a vibrating table and wires drawn out from the other connector are fixed to a wire fixing portion provided on the vibrating table. By vibrating the vibrating table at a predetermined frequency in a direction perpendicular to the connecting direction of the connector, vibration is applied to the one connector and the wires drawn out from the other connector. A displacement amount of the other connector is measured using a laser displacement meter. A frequency at which a displacement response magnification between the male connector and the female connector is two-fold or higher and the phase of the vibration applied by the vibrating table and the phase of the displacement measured by the laser displacement meter are shifted by $\pi/2$ is assumed as a connector resonant frequency. The predetermined frequency can be, for example, 500 Hz to 2000 Hz.

The rigidity of the connector in the state where the male connector and the female connector are connected can be, for example, measured as follows. The male connector including the male receptacle open in the connecting direction and the female connector including the housing to be fit to the male connector are connected along the connecting direction. With the male connector and the female connector connected, the male connector and the female connector are left for a predetermined time in the constant temperature chamber or constant temperature bath regulated to a test temperature until the temperatures of the male connector and the female connector become equal to an ambient temperature. The predetermined time can be, for example, set at about 1 hour. One of the male connector and the female connector is fixed to the connector fixing portion. A tool disposed on a load cell at a position of the other connector near an end part opposite to the connector fixing portion in the connecting direction is pressed at a predetermined test speed in a direction perpendicular to the connecting direction. The rigidity k of the connector in the state where the male connector and the female connector are connected is calculated from a gradient of a resilient deformation region of a load-displacement curve (F-S curve) obtained at this time. The predetermined test speed can be, for example, 1 mm/min.

In the connector of this embodiment, the rigidity k of the connector in the state where the male connector and the female connector are connected is preferably less than 360000, exclusive of 360000. This is because a connection force of the male connector and the female connector increases if a clearance between the male connector and the female connector is made smaller to enhance the rigidity k of the connector.

Embodiment

One embodiment of the technique disclosed in this specification is described with reference to FIGS. 1 to 14. A connector 70 of this embodiment includes a male connector 10 and a female connector 20 and is, for example, disposed in a power supply path of a vehicle such as an automotive vehicle. In the following description, an X direction, a Y direction and a Z direction of FIG. 1 are referred to as a forward direction, a leftward direction and an upward direction.

Male Connector 10

Figure 2:
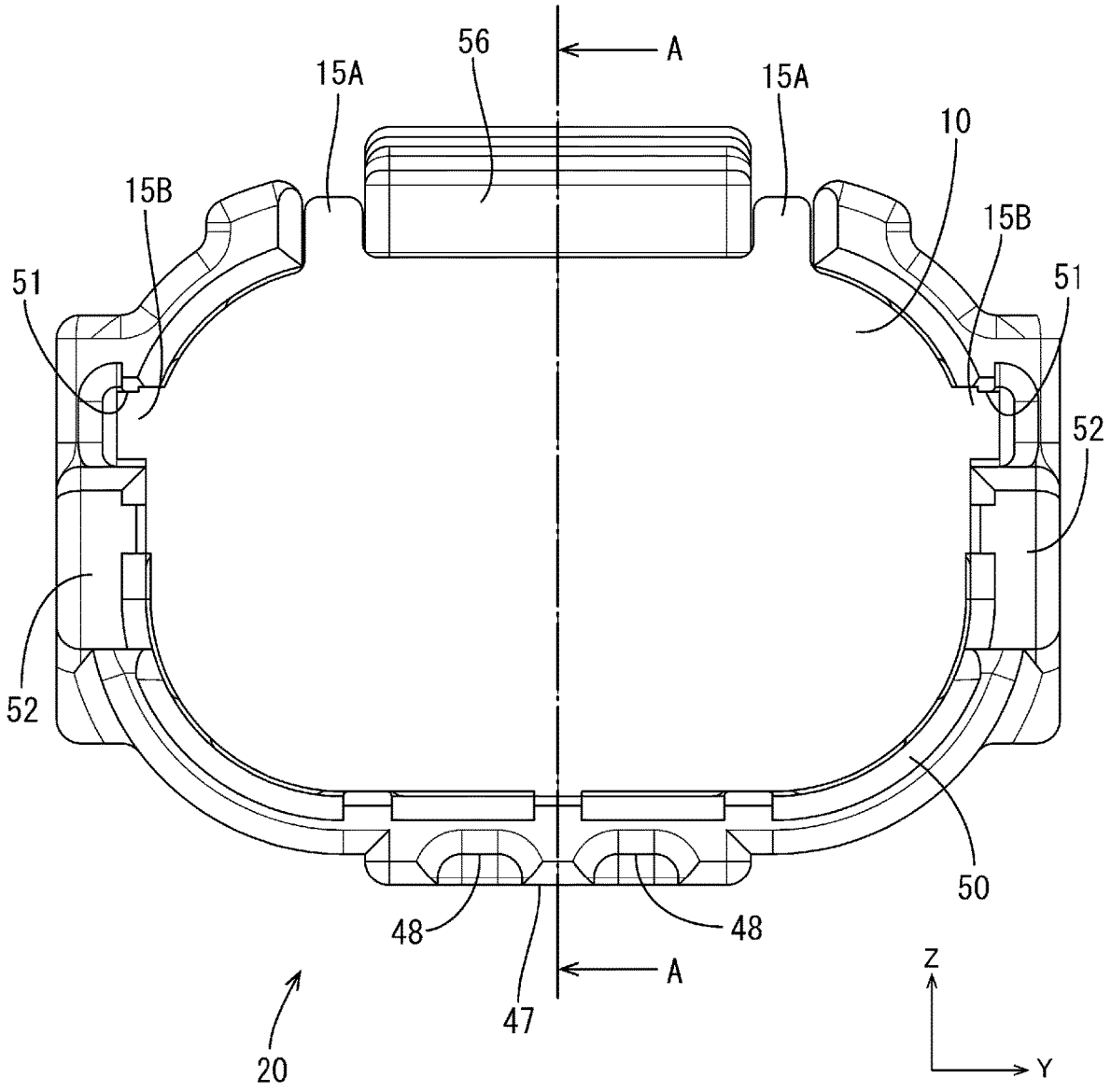
FIG. 2 is a front view showing the connector.
Figure 3:
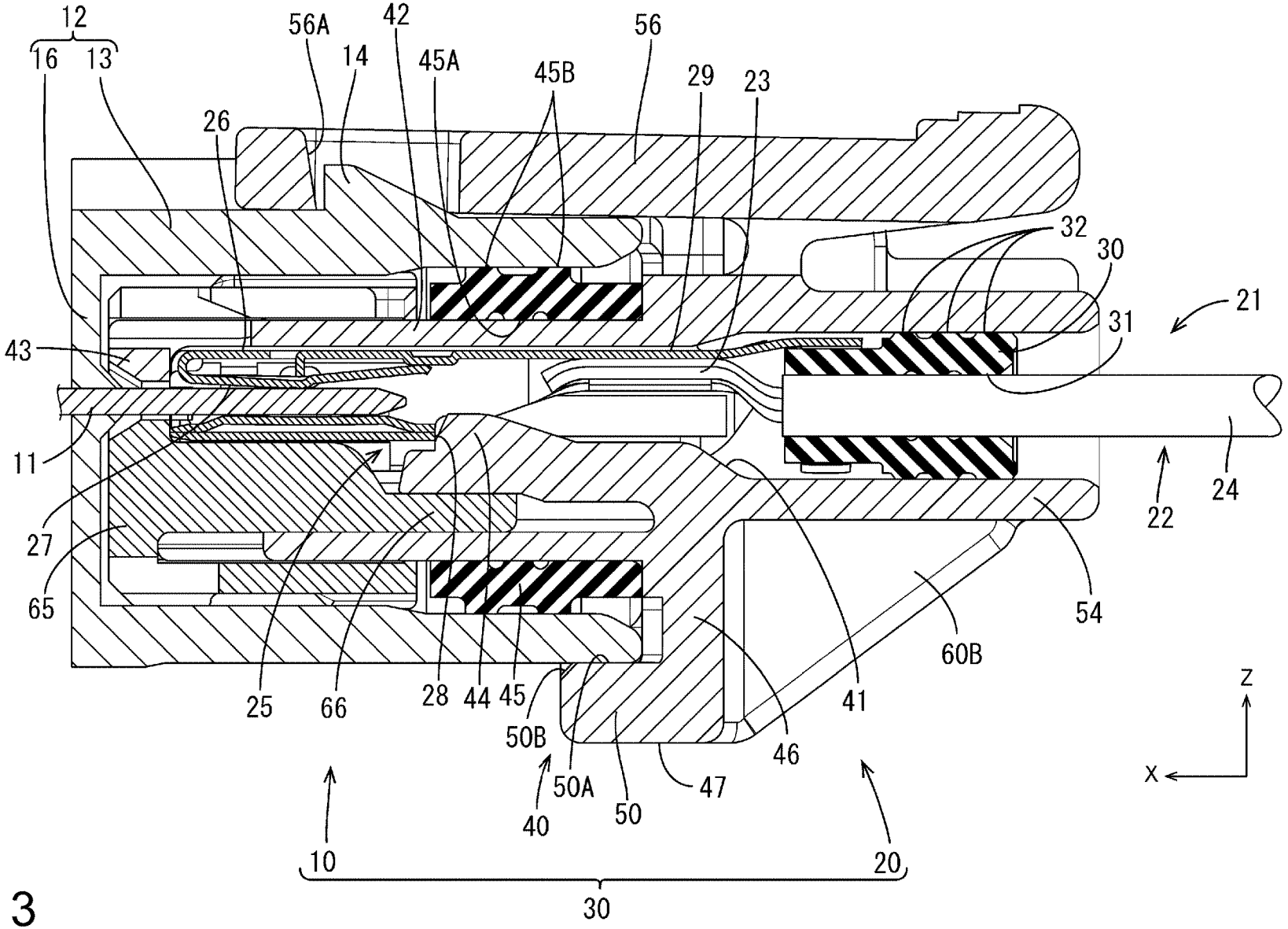
FIG. 3 is a section along A-A of FIG. 2.

As shown in FIG. 3, the male connector 10 includes male terminals 11 (front sides of the male terminals 11 are not shown in FIGS. 1 to 3) and a male housing 12 made of insulating synthetic resin for holding the male terminals 11. The male housing 12 includes an open receptacle 13 and a back wall portion 16 closing the receptacle 13. The male terminals 11 project into the receptacle 13 through the back wall portion 16, and the unillustrated front parts are, for example, bent into an L shape.

The receptacle 13 is in the form of an elliptical tube long in a lateral direction and a lock protrusion 14 projects upward in a step-like manner on the top of the outer surface of the receptacle 13. As shown in FIG. 1, a plurality of ridges 15A, 15B extending in a front-rear direction (connecting direction) project outward on the outer periphery of the receptacle 13. The plurality of ridges 15A, 15B include a pair of left and right ridges 15A spaced apart on the top of the receptacle 13 and a pair of left and right ridges 15B provided on both side surfaces of the receptacle 13.

Female Connector 20

Figure 7:
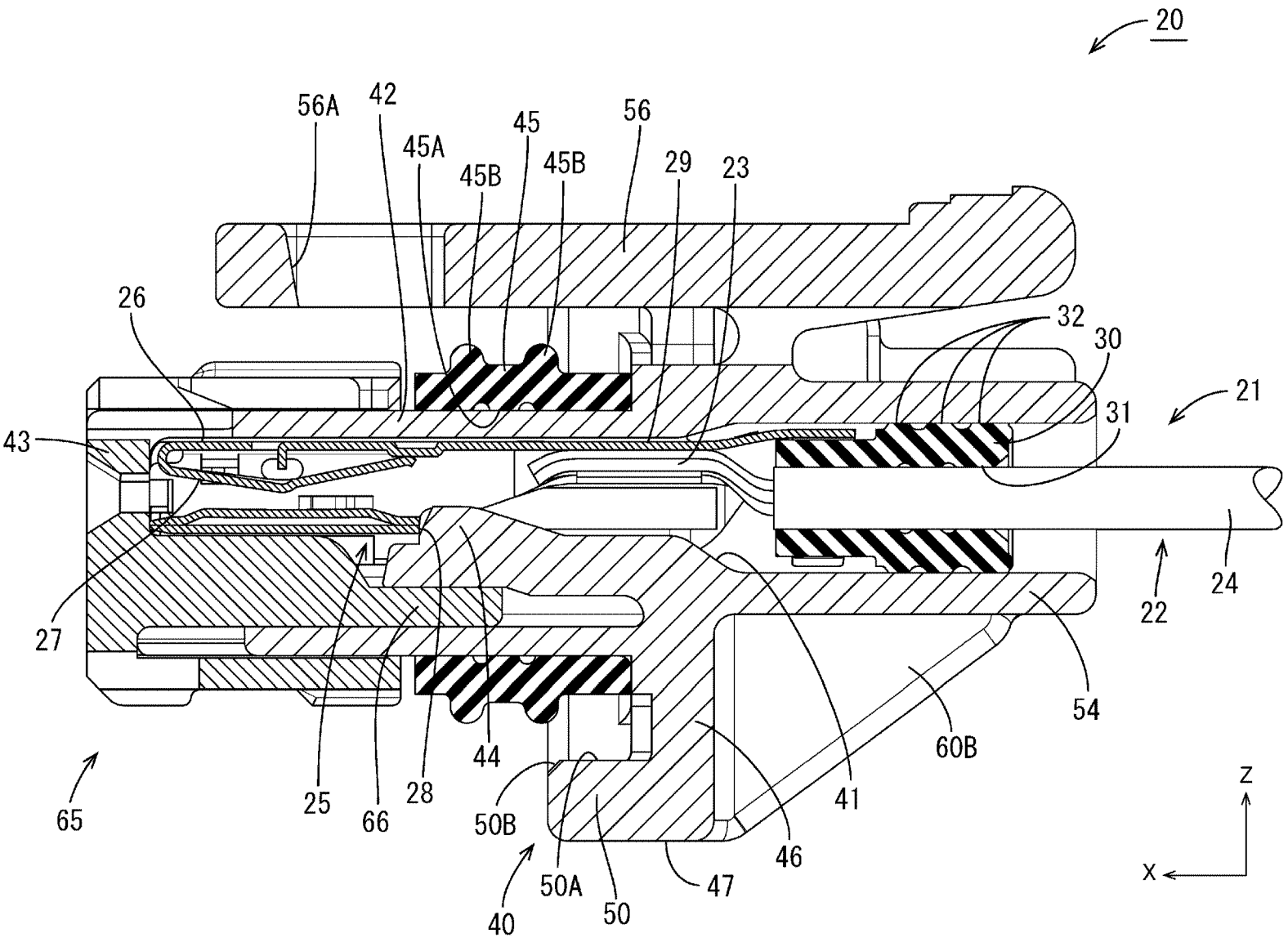
FIG. 7 is a section along B-B of FIG. 6.
Figure 8:
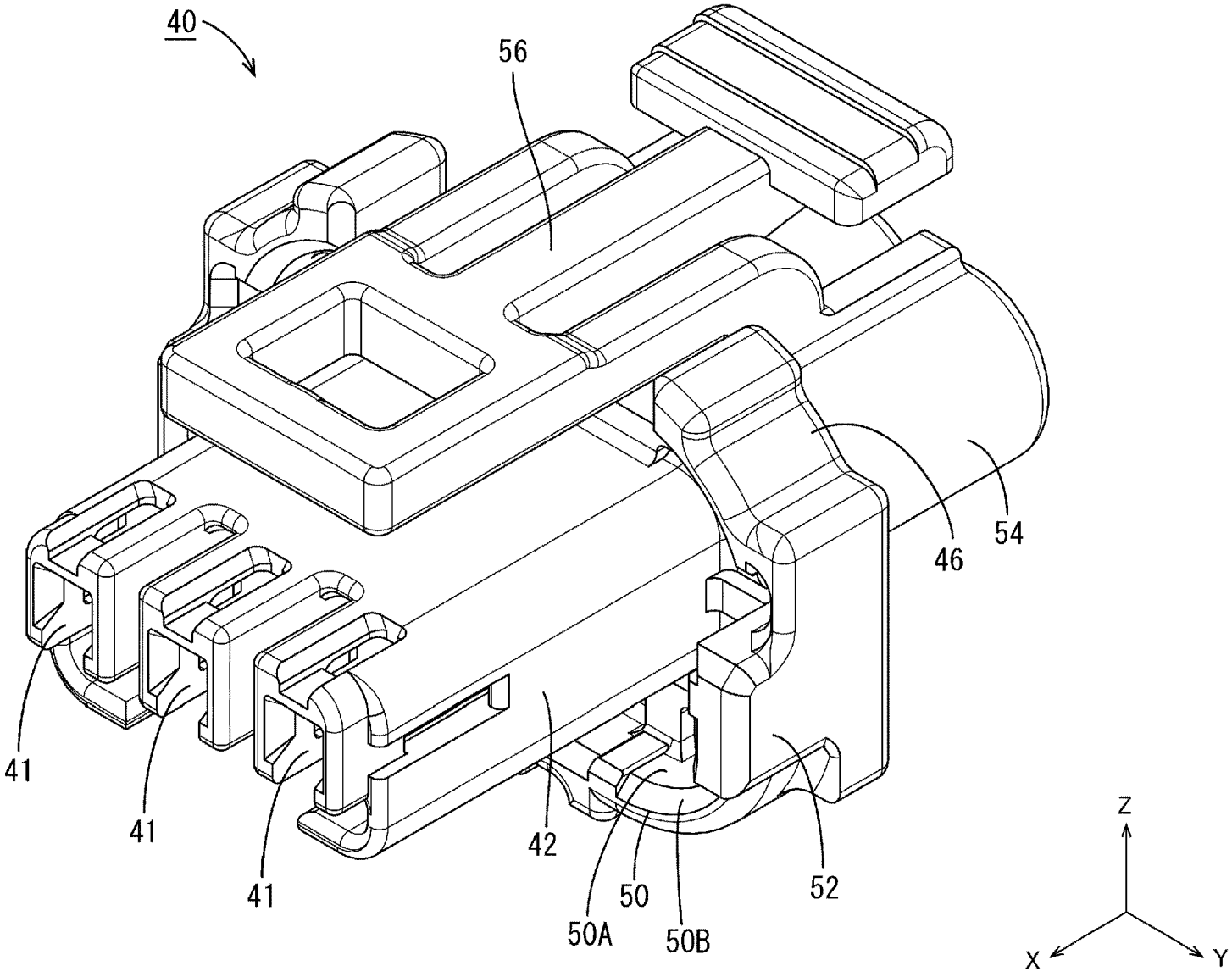
FIG. 8 is a perspective view showing a housing of the female connector.
Figure 9:
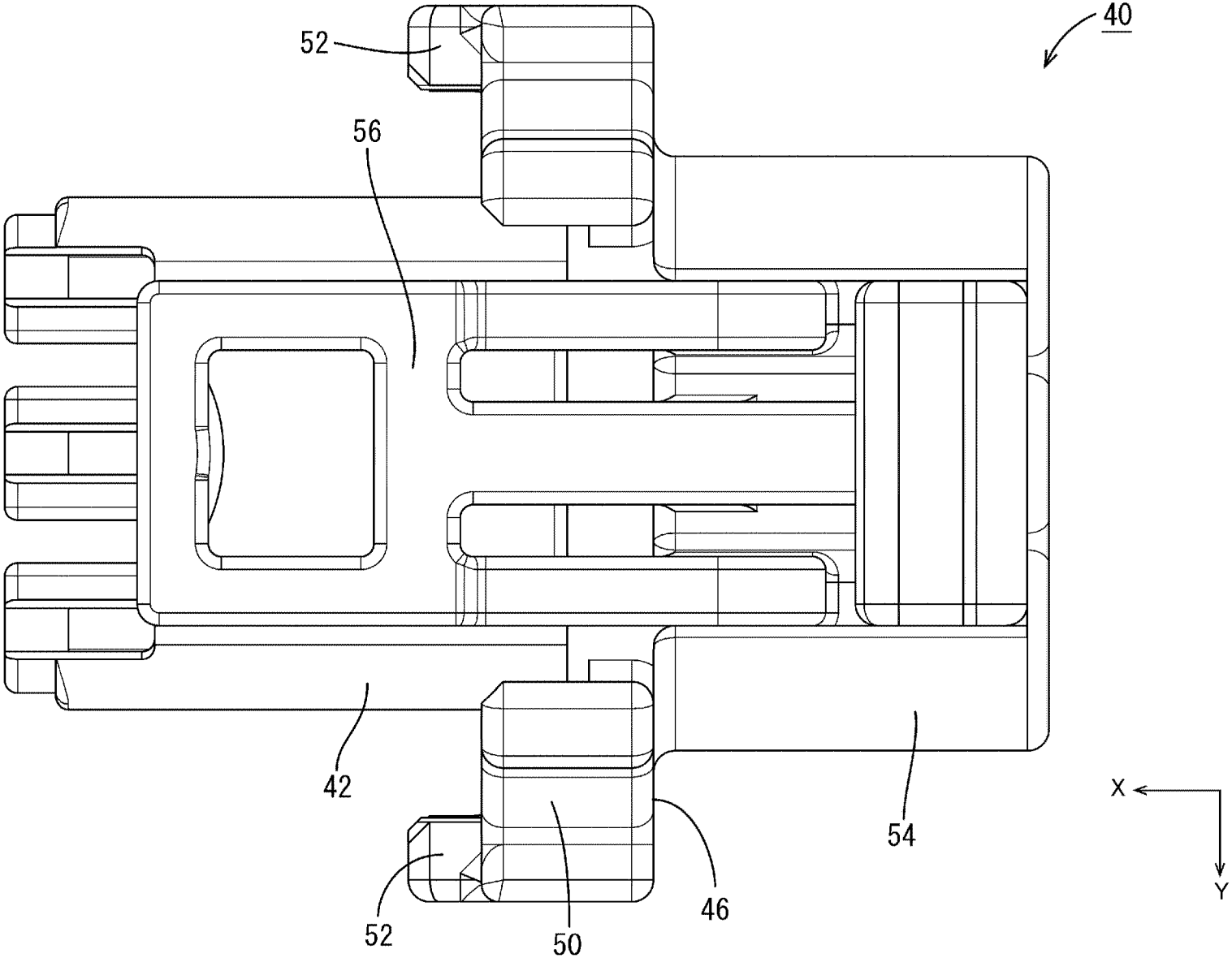
FIG. 9 is a plan view showing the housing of the female connector.

As shown in FIG. 7, the female connector 20 includes a plurality of (three in this embodiment) terminal-provided wires 21, a housing 40 made of insulating synthetic resin for holding terminals 25 and a retainer 65 to be mounted on a front side of the housing 40.

Terminal-Provided Wires 21

The terminal-provided wire 21 is such that the terminal 25 is connected to an end part (end) of a wire 22. The wire 22 is an insulated wire in which a conductor 23 is covered by an insulation coating 24, and the conductor 23 is, for example, a stranded wire formed by twisting a multitude of metal strands.

The terminal 25 includes a terminal connecting portion 26 to be connected to the male terminal 11 and a wire connecting portion 29 to be connected to the wire 22. The terminal connecting portion 26 is box-shaped and includes a resilient contact piece 27 folded inwardly from a tip part. The resilient contact piece 27 resiliently contacts the male terminal 11 inserted into the terminal connecting portion 26. A rear part of the terminal connecting portion 26 is cut to form a cutout portion 28. The cutout portion 28 is locked to a locking lance 44 of the housing 40, whereby the terminal 25 is retained against a force in a withdrawing direction. The wire connecting portion 29 is crimped to the conductor 23 exposed at the end part of the wire 22.

A tubular rubber plug 30 is mounted on the wire 22. The rubber plug 30 is held in close contact with the insulation coating 24 of the wire 22 and formed with a wire insertion hole 31 penetrating in the front-rear direction. The wire 22 is inserted through the wire insertion hole 31. Wavy lip portions 32 extending in a circumferential direction are formed side by side in the front-rear direction on the outer periphery of the rubber plug 30. This rubber plug 30 seals between the wire 22 and the hole wall of an insertion hole 41 of the housing 40, thereby suppressing the intrusion of water and the like toward the terminal 25 through an opening of the insertion hole 41 of the housing 40.

Housing 40

The housing 40 is formed with a plurality of (three in this embodiment) insertion holes 41 penetrating in the front-rear direction. The terminal-provided wires 21 are inserted into the insertion holes 41 while being laterally arranged. The housing 40 includes a terminal accommodation chamber 42 for accommodating the terminals 25, a protruding portion 46 (protrusion) protruding outward from the terminal accommodation chamber 42, an external fitting portion 50 (external fitting) projecting from the protruding portion 46 toward the receptacle 13 to be externally fit to a tip part of the receptacle 13, a lead-out portion 54 (lead-out) disposed behind the terminal accommodation chamber 42, the wires 22 being led out from the lead-out portion 54, and a plurality of reinforcing ribs 60A, 60B connected to the protruding portion 46 and the lead-out portion 54.

A length of the housing 40 in the front-rear direction is about 25 mm, a width thereof in the lateral direction is about 22 mm and a height thereof in a vertical direction is about 15 mm.

The terminal accommodation chamber 42 has a rectangular parallelepiped shape and a front end part thereof is cut to enable the insertion of the male terminals 11 and formed with a front stop portion 43 for restricting forward movements of the terminals 25. The cantilevered locking lance 44 extends forward from the hole wall of the insertion hole 41. The locking lance 44 is resiliently deformable and retains the terminal 25 by locking the cutout portion 28 of the terminal 25. The protruding portion 46 protrudes outward on a base end part of the terminal accommodation chamber 42. A seal ring 45 is mounted on the outer periphery of the terminal accommodation chamber 42. The seal ring 45 is formed of a resiliently deformable material such as rubber, wavy lip portions 45A, 45B arranged side by side in the front-rear direction are circumferentially formed on inner and outer peripheries, and the outer surface of the seal ring 45 is held in close contact with the inner surface of the receptacle 13 when the both housings 12, 40 are connected.

Figure 10:
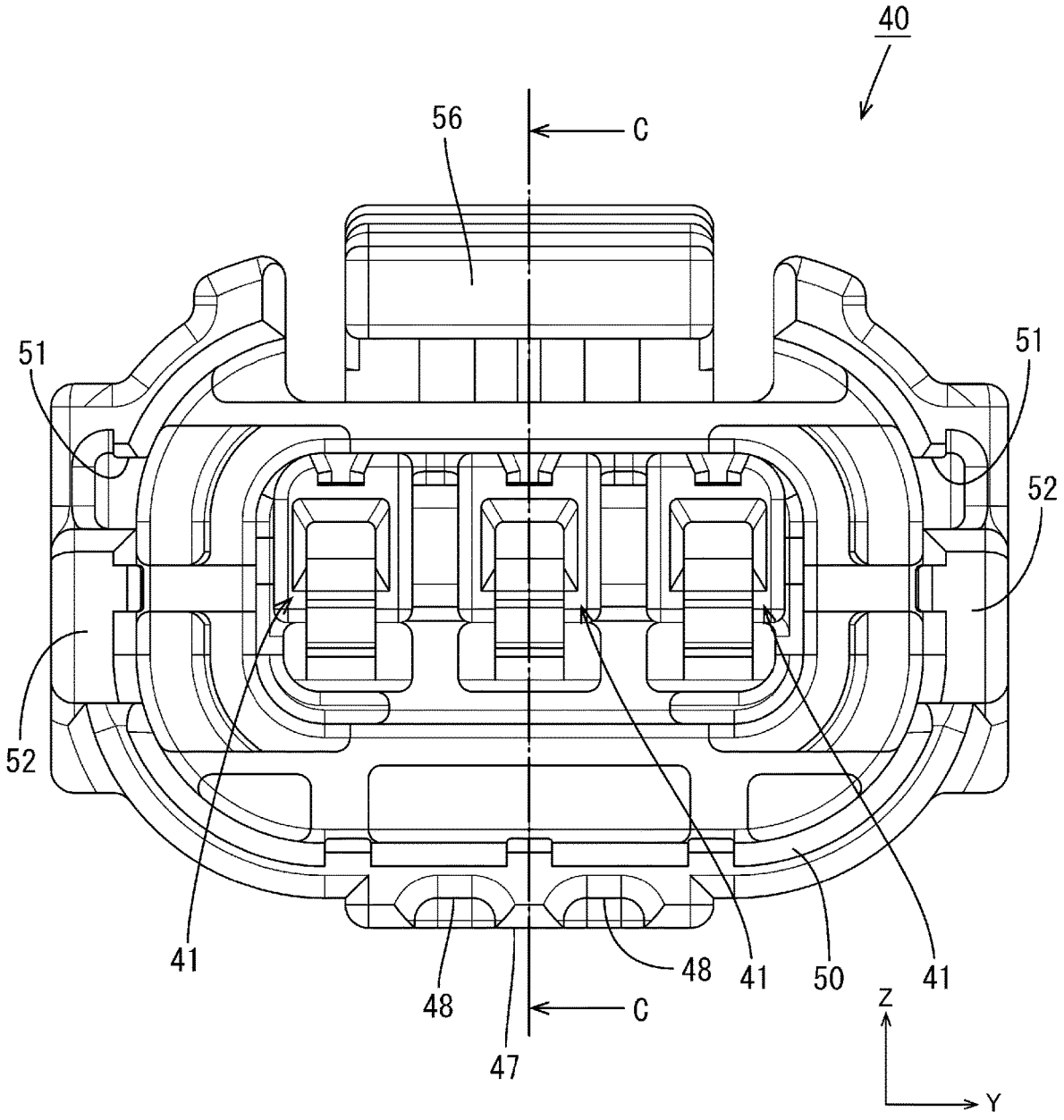
FIG. 10 is a front view showing the housing of the female connector.
Figure 11:
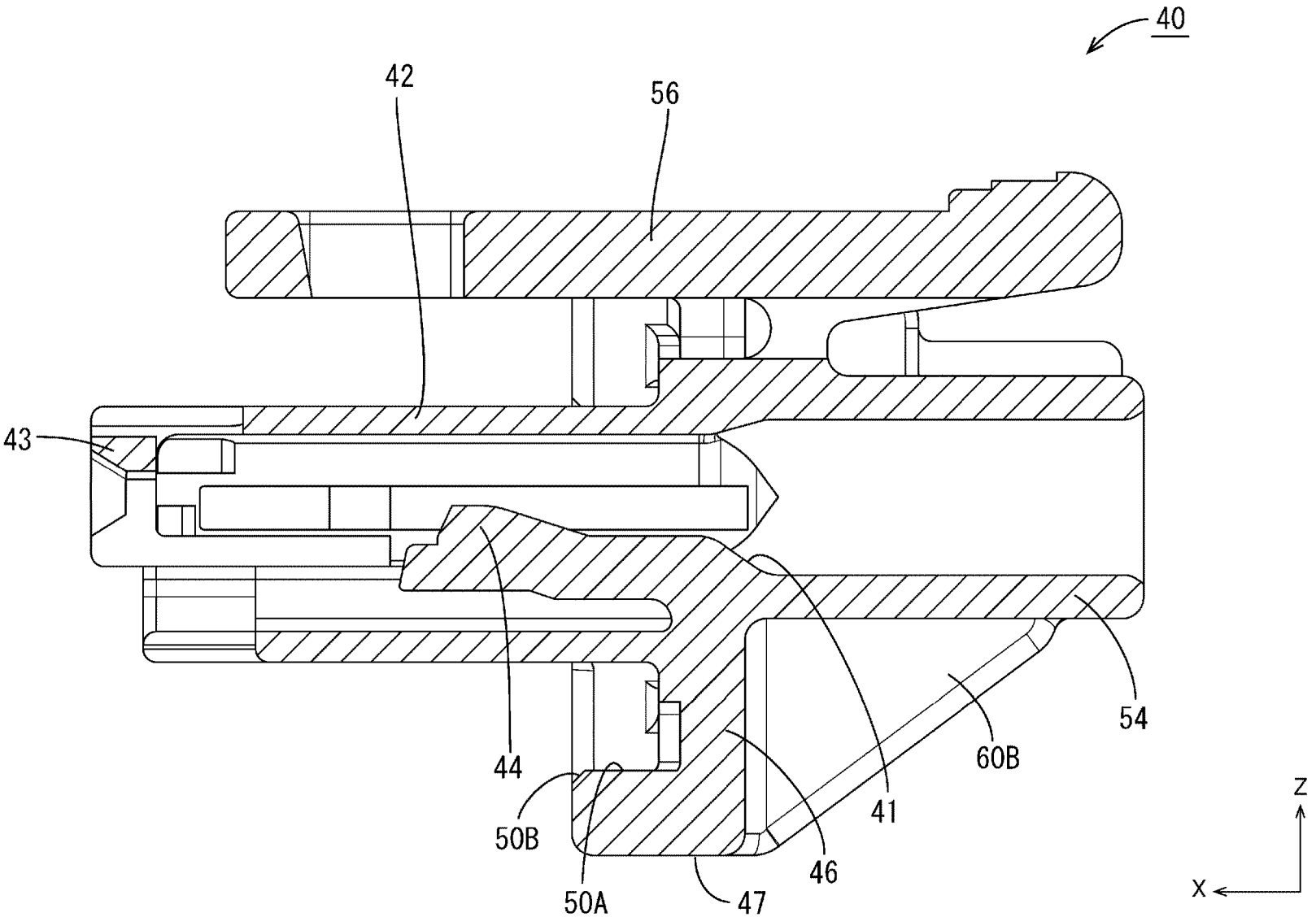
FIG. 11 is a section along C-C of FIG. 10.
Figure 13:
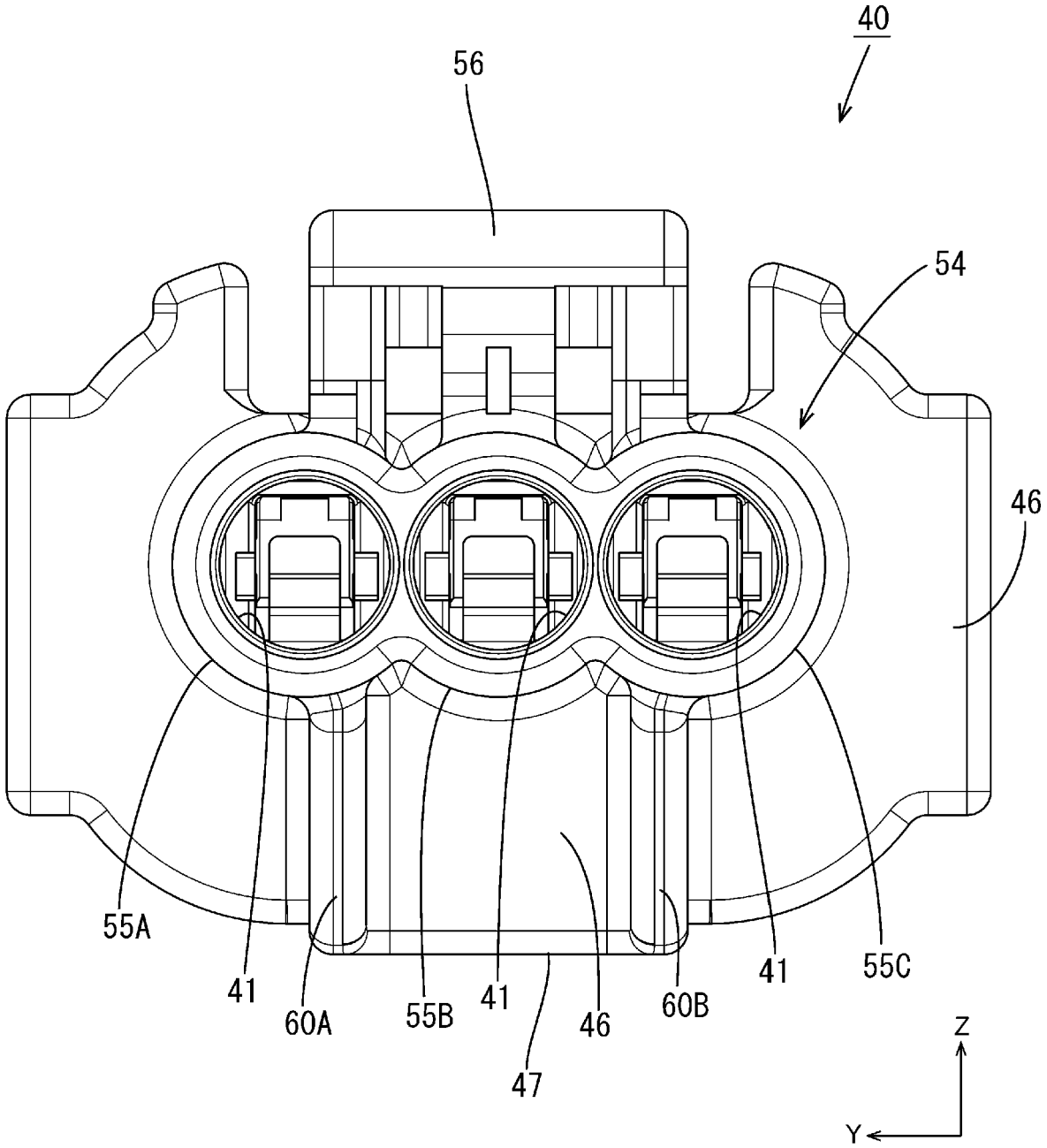
FIG. 13 is a back view showing the housing of the female connector.
Figure 14:
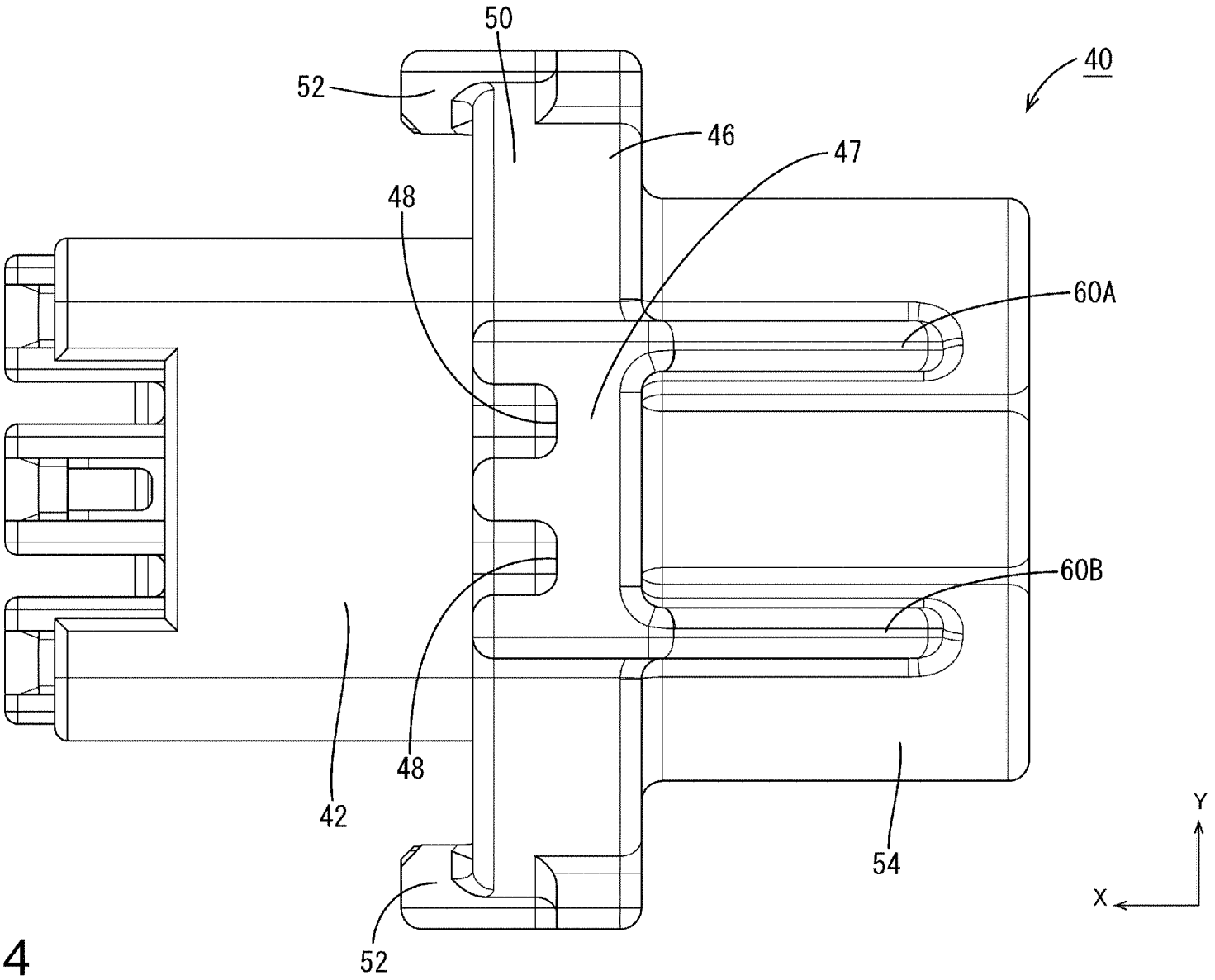
FIG. 14 is a bottom view showing the housing of the female connector.

The protruding portion 46 annularly extends along the outer periphery of the terminal accommodation chamber 42 (and the receptacle 13). An upper part of the protruding portion 46 is divided as shown in FIG. 1, and a lock arm 56 extends in the front-rear direction in a dividing clearance. The lock arm 56 restricts the separation of the both connectors 10, 20 (both housings 12, 40) by having the lock protrusion 14 inserted into a lock hole 56A. As shown in FIG. 10, a lower end part of the circumferentially extending protruding portion 46 has an increased thickness on a lower surface side, thereby forming a thick portion 47 protruding downward (outward) a predetermined distance. The thick portion 47 is formed from the lower part of the protruding portion 46 to a lower part of the external fitting portion 50 located in front, and formed in a region between parts, to which the pair of reinforcing ribs 60A, 60B are connected, on an outer peripheral edge part of the protruding portion 46 as shown in FIG. 13. A front part of the thick portion 47 is formed with has a front side cut to be thinned, thereby forming a pair of recesses 48 as shown in FIG. 10.

The external fitting portion 50 is in the form of a plate projecting forward from the outer peripheral edge of the protruding portion 46 and annularly extends along the outer periphery of the receptacle 13. When the receptacle 13 of the male connector 10 is fit to the external fitting portion 50, an inner surface 50A of the external fitting portion 50 faces an outer side of the tip part of the receptacle 13 as shown in FIG. 3. In this way, the outer surface of the tip part of the receptacle 13 is covered by the external fitting portion 50 and the outer surface of a base end side (front side) of the receptacle 13 is exposed without being covered by the external fitting portion 50. A tapered portion 50B is formed on a tip part (front end part) of the external fitting portion 50 by obliquely cutting the inner surface 50A forward. As shown in FIG. 2, the external fitting portion 50 is formed with fit-in portions 51 into which the left and right ridges 15B of the receptacle 13 are fit. The ridges 15A on the top are fit into clearances between the external fitting portion 50 and the lock arm 56. Plate-like extending pieces 52 formed by extending the external fitting portion 50 forward extend forward on both left and right end parts of the external fitting portion 50.

Figure 4:
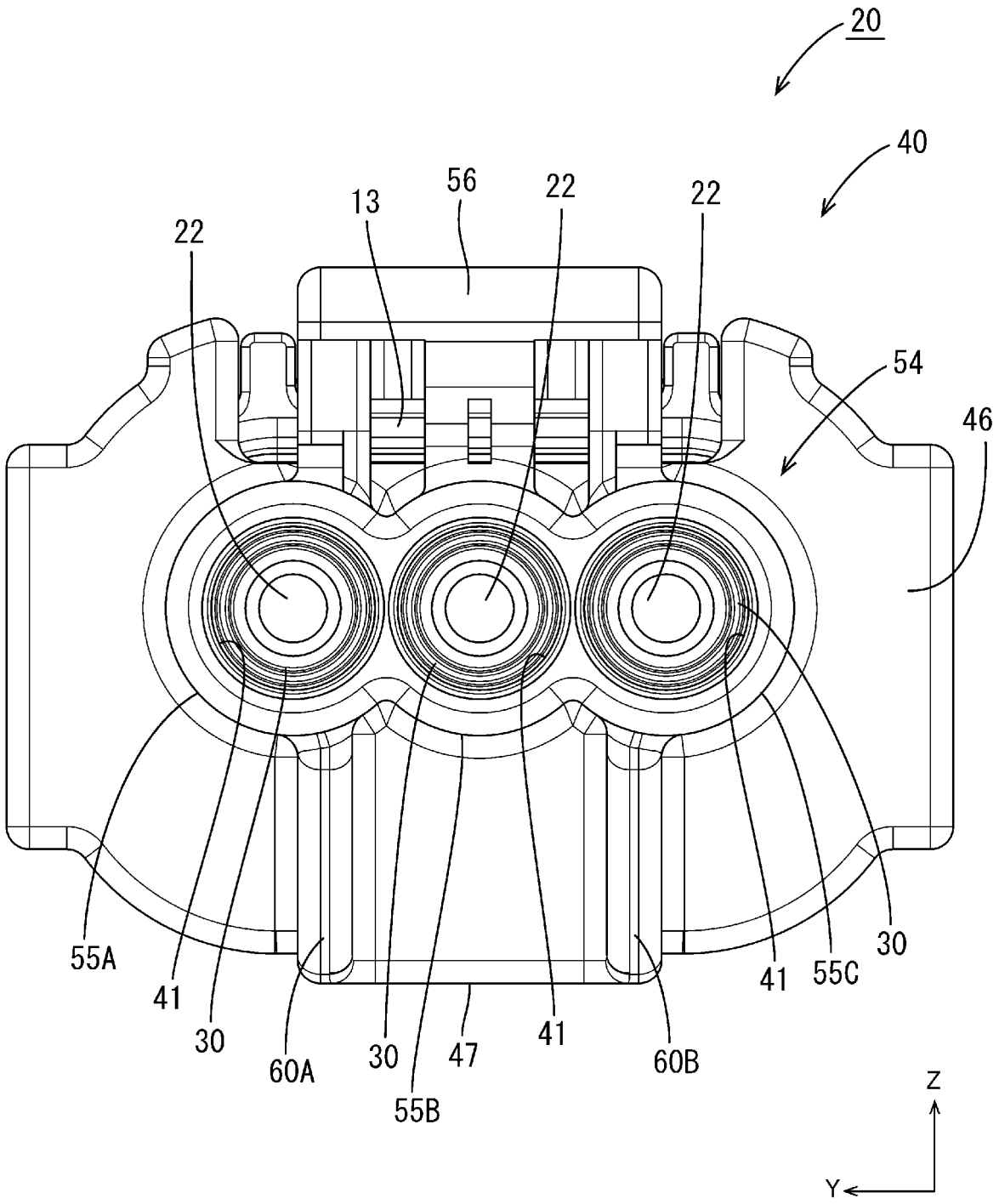
FIG. 4 is a back view showing the connector.
Figure 5:
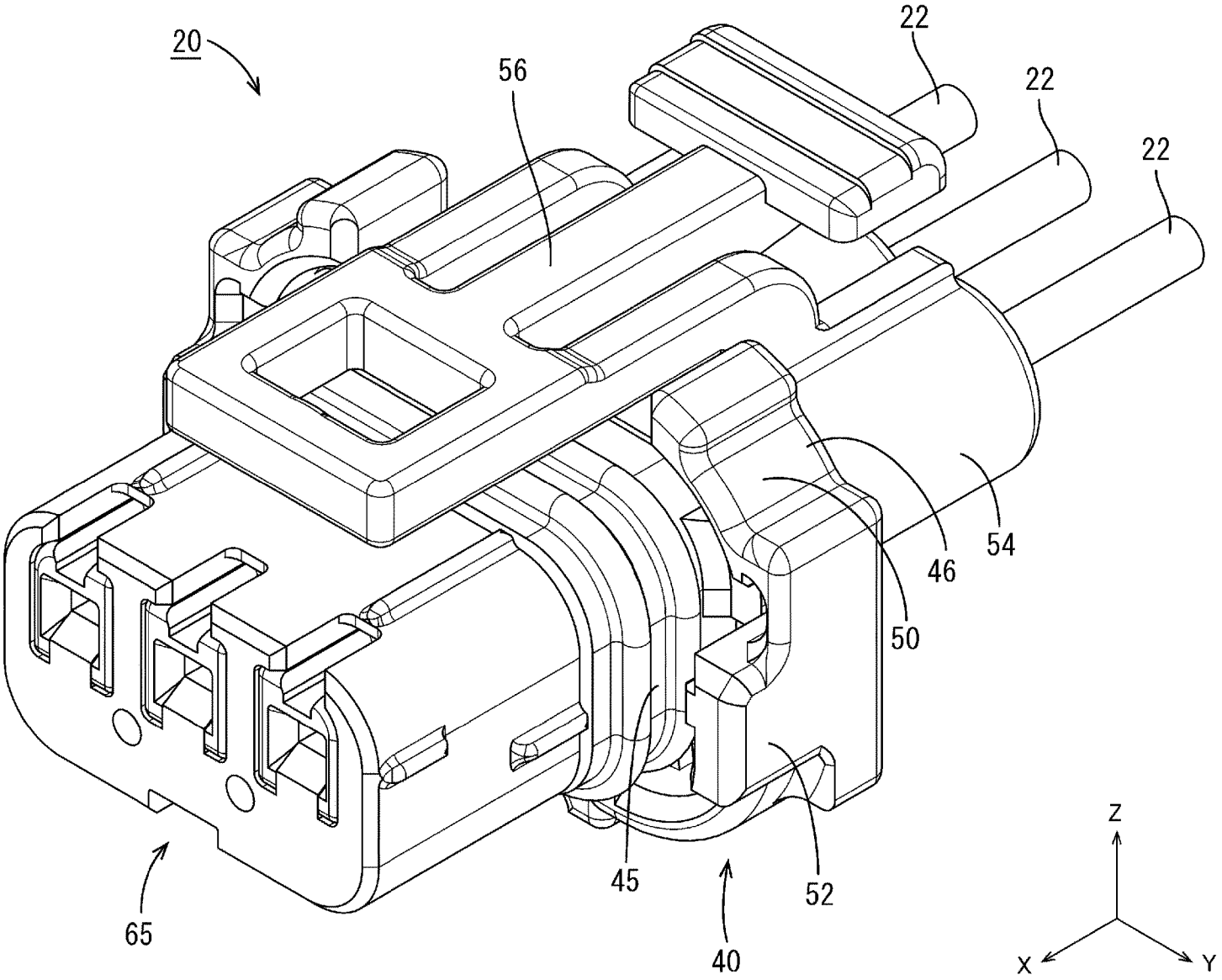
FIG. 5 is a perspective view showing a female connector.
Figure 6:
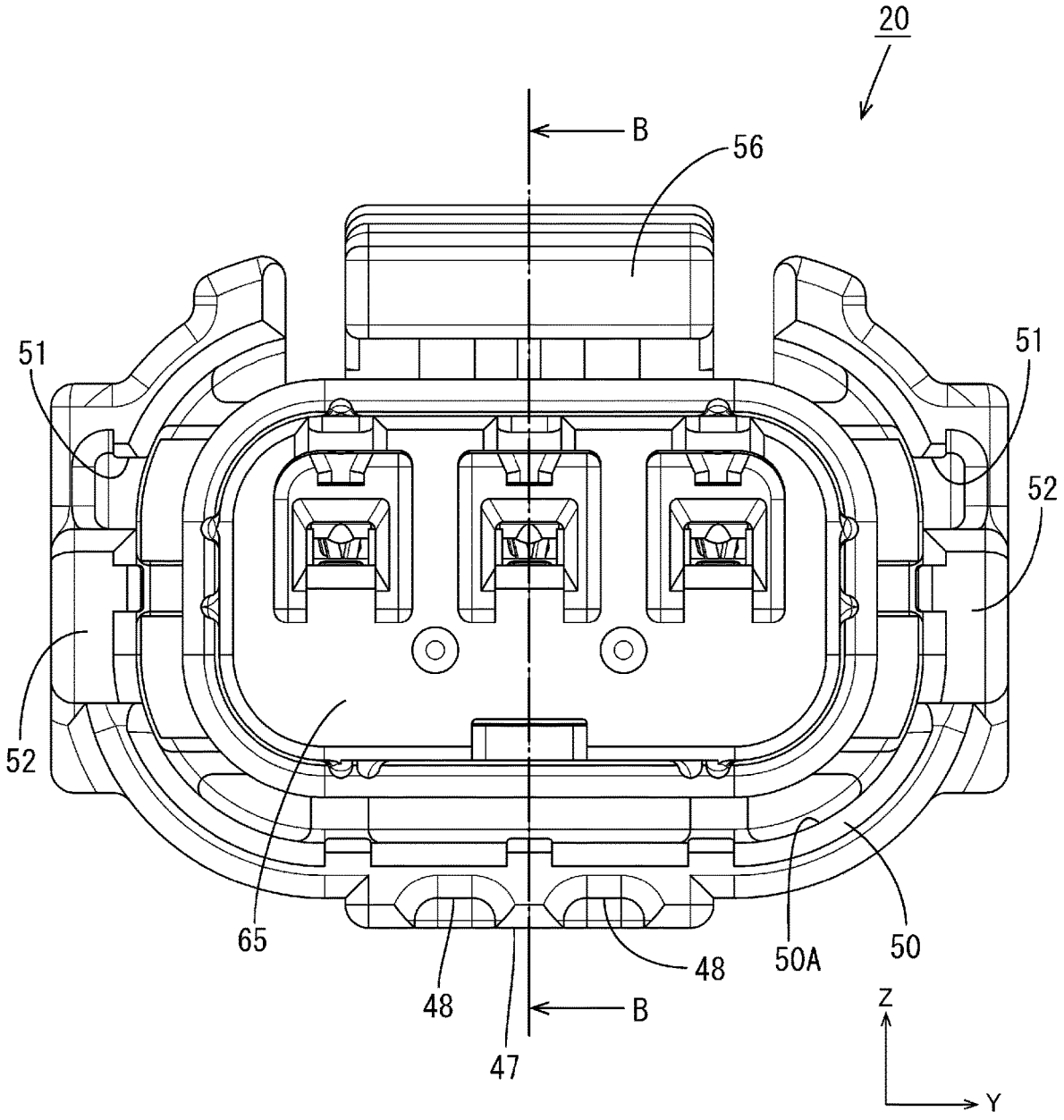
FIG. 6 is a front view showing the female connector.

As shown in FIG. 4, the lead-out portion 54 has a flat shape long in the lateral direction, and openings of three insertion holes 41 are arranged side by side in the lateral direction inside the lead-out portion 54. The rubber plug 30 having the wire 22 inserted therethrough is held in close contact with the inner wall of each insertion hole 41 of the lead-out portion 54. The outer periphery of the lead-out portion 54 is formed by laterally connecting three arc portions 55A to 55C arranged along the insertion holes 41. The lock arm 56 extends forward from the upper surface of the lead-out portion 54.

Figure 12:
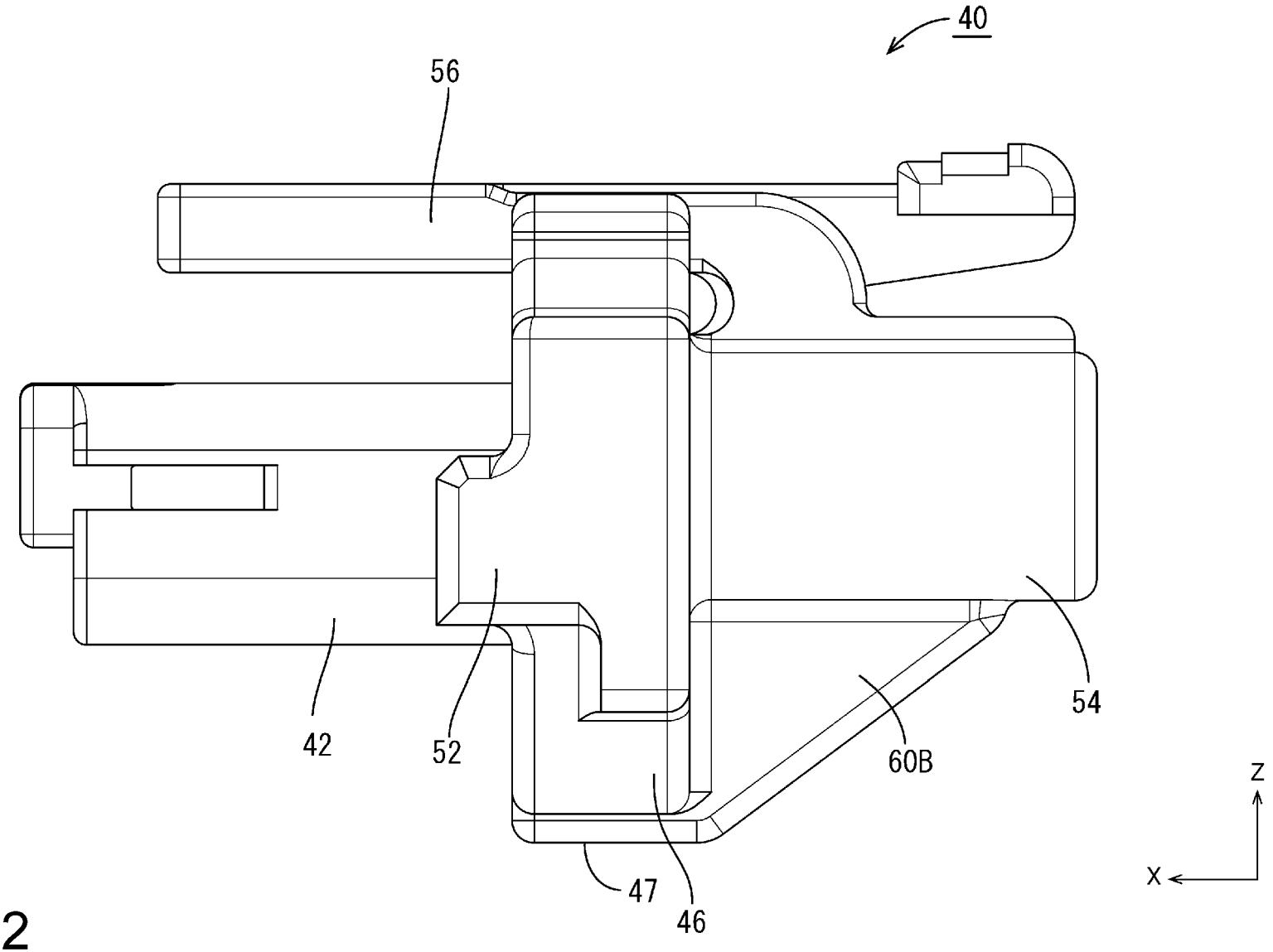
FIG. 12 is a side view showing the housing of the female connector.

The plurality of reinforcing ribs 60A, 60B are in the form of triangular plates in a side view as shown in FIG. 12. A pair of left and right reinforcing ribs 60A, 60B extend in parallel to each other, are integrally connected to the lead-out portion 54 somewhat inwardly of center axes of the left and right arc portions 55A, 55C on the side of the lead-out portion 54 and are integrally connected to the protruding portion 46 and have lower end parts integrally connected to the thick portion 47 on the side of the protruding portion 46.

The retainer 65 is made of synthetic resin and, as shown in FIG. 7, mounted on the front side of the housing 40 and includes a deflection restricting piece 66 for restricting the deflection of the locking lances 44 by entering between the locking lances 44 and the inner wall of the terminal accommodating portion 42. Further, a front end side of the retainer 65 is open so that the male terminals 11 are insertable.

Next, a manufacturing method of the female connector 20 is described.

The insulation coatings 24 on the end parts of the wires 22 are stripped to expose the conductors 23, the exposed conductors 23 are passed through the wire insertion holes 31 of the rubber plugs 30 and the rubber plugs 30 are mounted on the outer peripheries of the insulation coatings 24 of the wires 22. Further, the wire connecting portions 29 of the terminals 25 are crimped to the exposed conductors 23. In this way, the terminal-provided wires 21 are formed.

As the terminal-provided wire 21 is inserted into the insertion hole 41 of the housing 40, the locking lance 44 contacted by the terminal 25 is resiliently deformed. When the locking lance 44 reaches a position behind the cutout portion 28 of the terminal 25, the locking lance 44 is restored to lock the cutout portion 28. In this way, the terminal-provided wire 21 is mounted at a proper position in the insertion hole 41. When the retainer 65 is mounted from the front of the housing 40, the deflection and deformation of the locking lances 44 are restricted (FIG. 7). In this way, the female connector 20 is formed.

Subsequently, when the male housing 12 is connected to the housing 40 from the front of the housing 40, the male terminals 11 resiliently contact the resilient contact pieces 27 of the terminals 25. Further, when the lock arm 56 is inclined by coming into contact with the lock protrusion 14 of the male housing 12 and the lock protrusion 14 reaches the lock hole 56A, the lock arm 56 is horizontally restored and the lock protrusion 14 is inserted into the lock hole 56A (FIG. 3). In this way, the both connectors 10, 20 are properly connected to restrict the separation of the both connectors 10, 20, and the connector 70 is completed. By doing so, the strengths of connecting parts of the protruding portion 46 and the reinforcing ribs 60A, 60B can be enhanced by the thick portion 47, wherefore troubles due to the deformation of the housing 40 can be suppressed.

Experimental Examples

Next, experimental examples showing effects of the technique disclosed in this specification are described.

Sample 1

The configuration of a connector according to Sample 1 is described with reference to FIGS. 15 to 26. A connector 170 according to Sample 1 includes a male connector 110 and a female connector 120.

Male Connector 110

Figure 15:
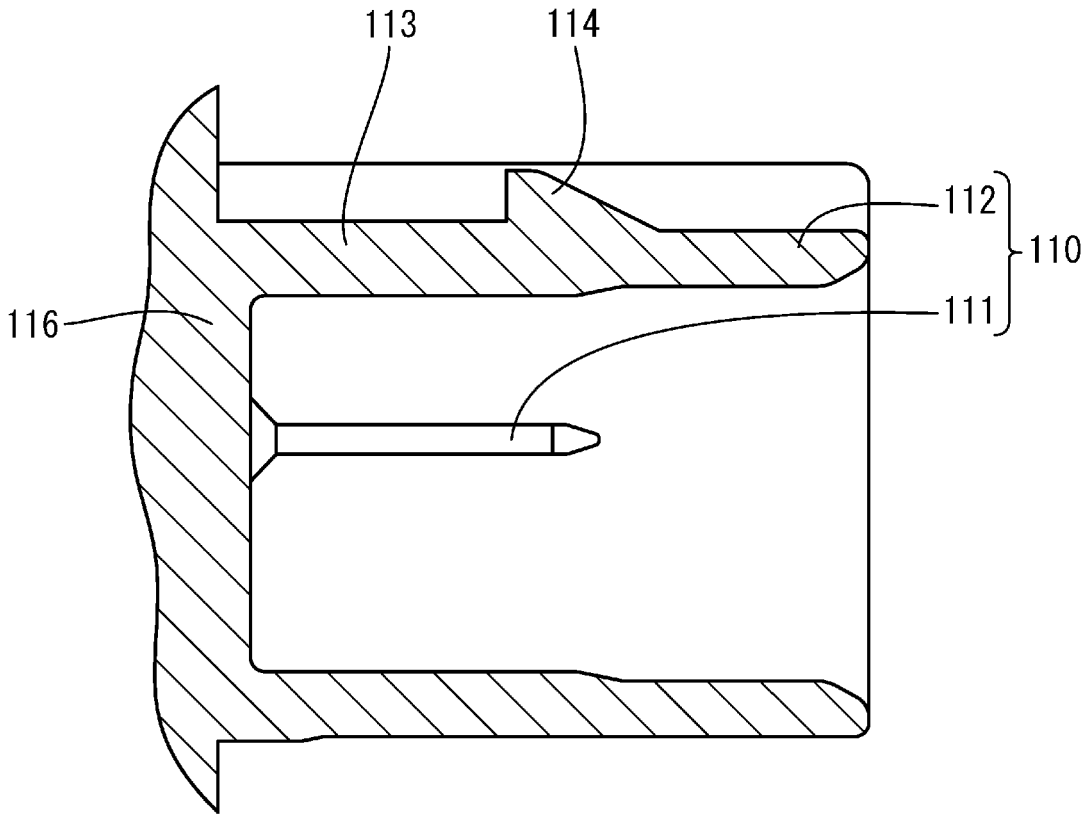
FIG. 15 is a section showing a male connector according to Sample 1.
Figure 16:
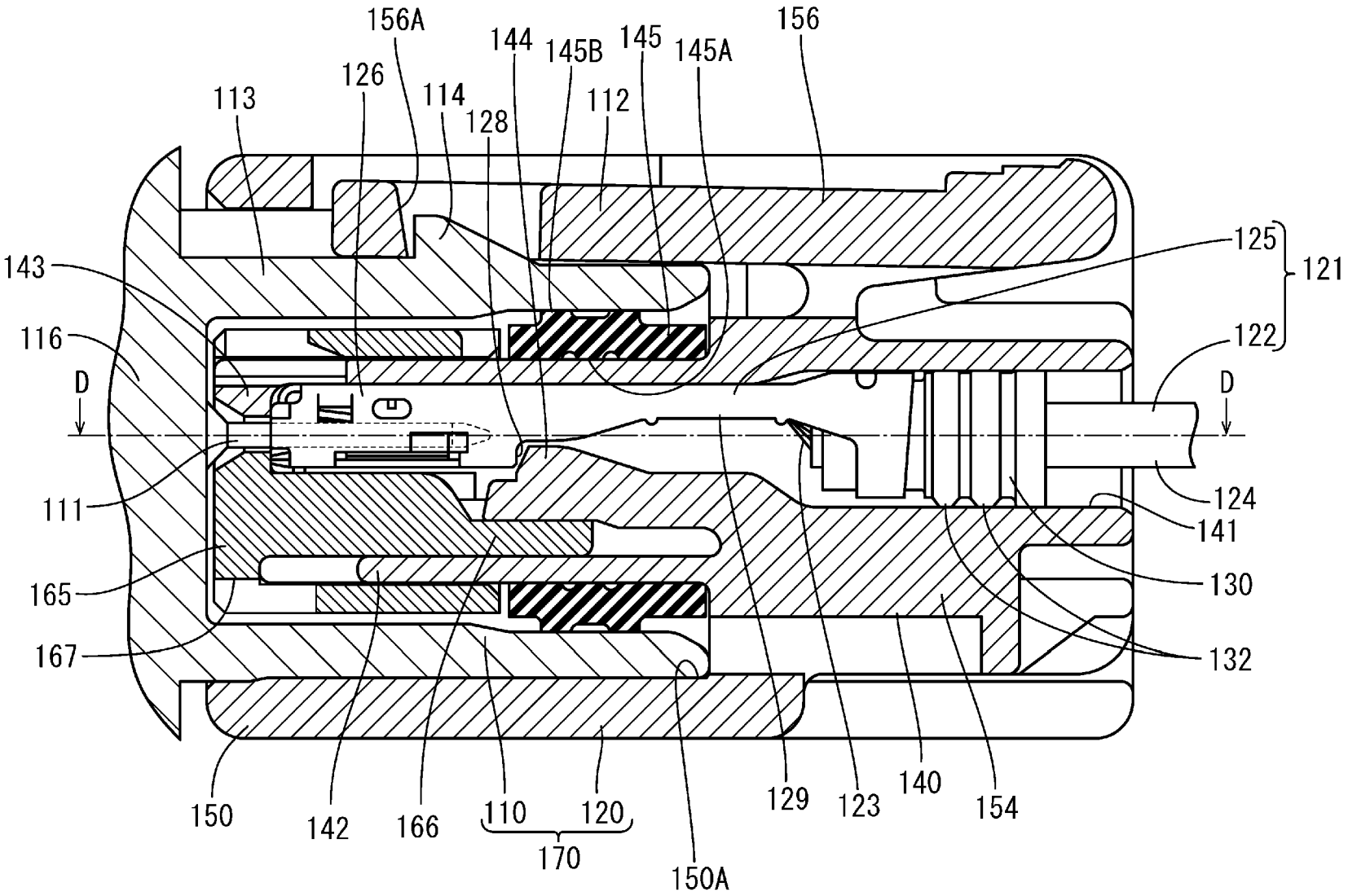
FIG. 16 is a section showing a connector according to Sample 1.

As shown in FIG. 15, the male connector 110 includes male terminals 111 and a male housing 112 made of insulating synthetic resin for holding the male terminals 111. The housing 112 according to Sample 1 is made of polybutylene terephthalate. The male housing 112 includes an open receptacle 113 and a back wall portion 116 closing the receptacle 113. The male terminals 111 project into the receptacle 113 through the back wall portion 116.

The receptacle 113 is in the form of an elliptical tube long in a lateral direction and a lock protrusion 114 projects upward in a step-like manner on the top of the outer surface of the receptacle 113.

Female Connector 120

Figure 17:
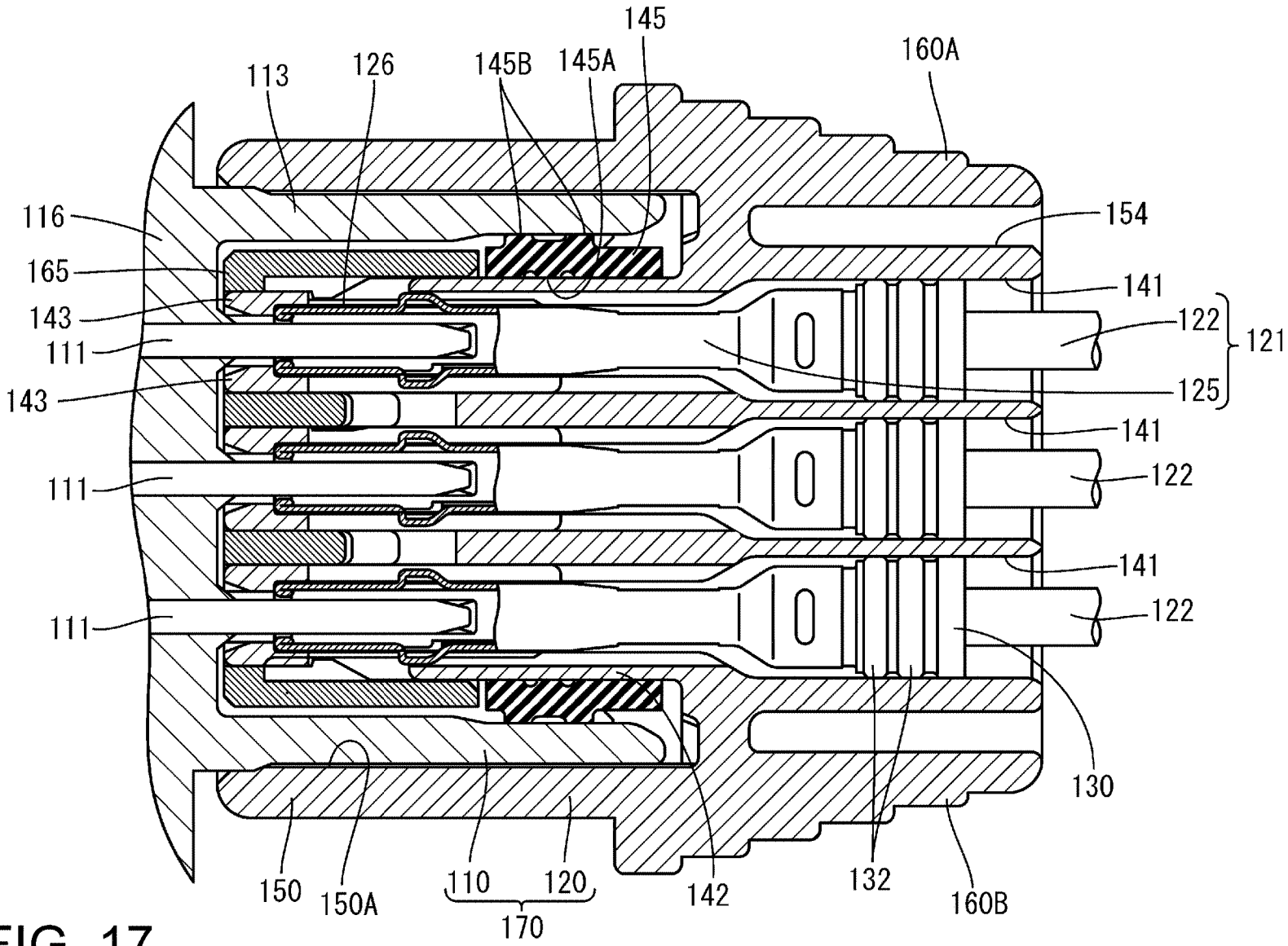
FIG. 17 is a section along D-D of FIG. 16 showing the connector.
Figure 18:
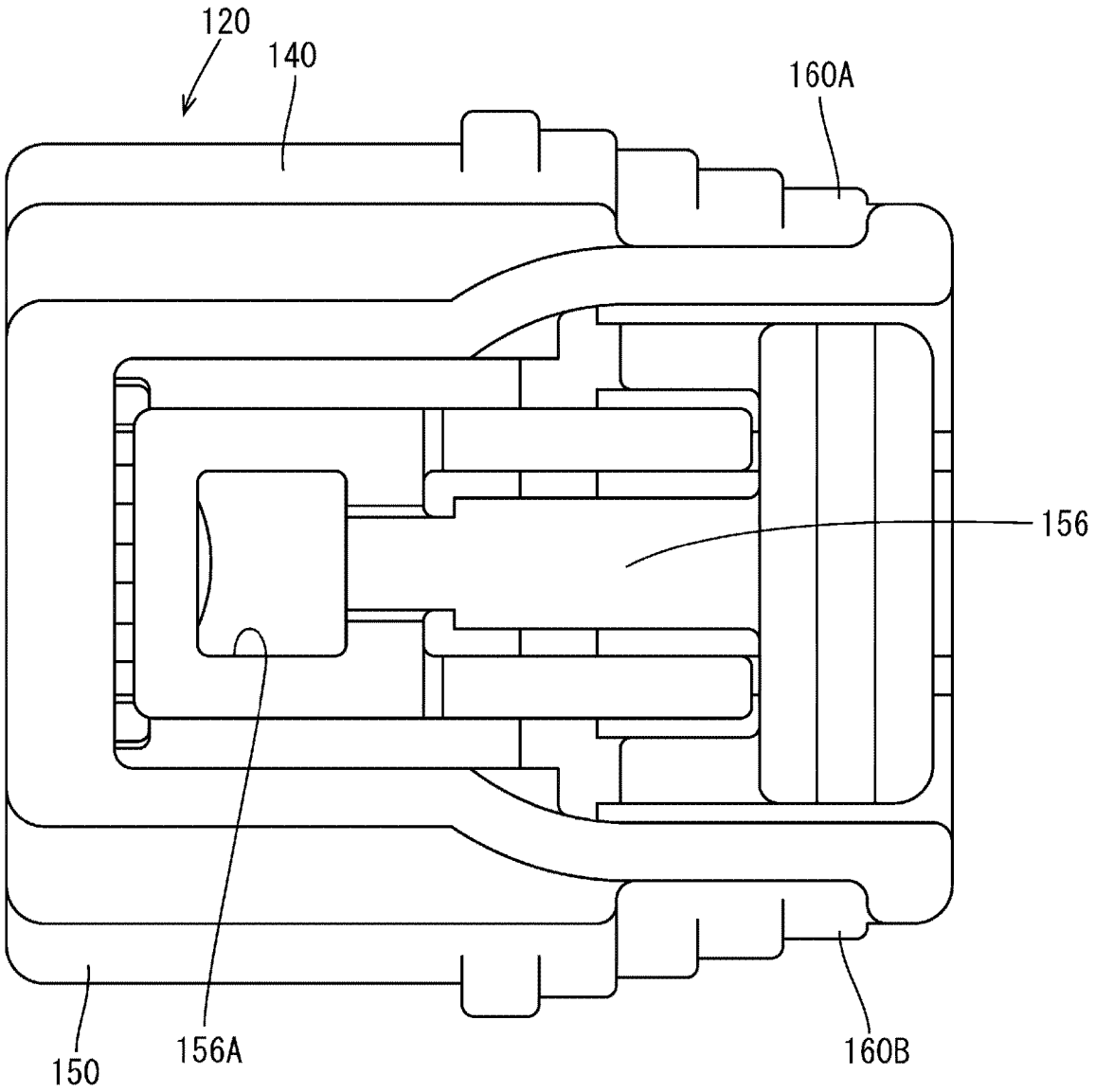
FIG. 18 is a plan view showing a housing of a female connector.
Figure 19:
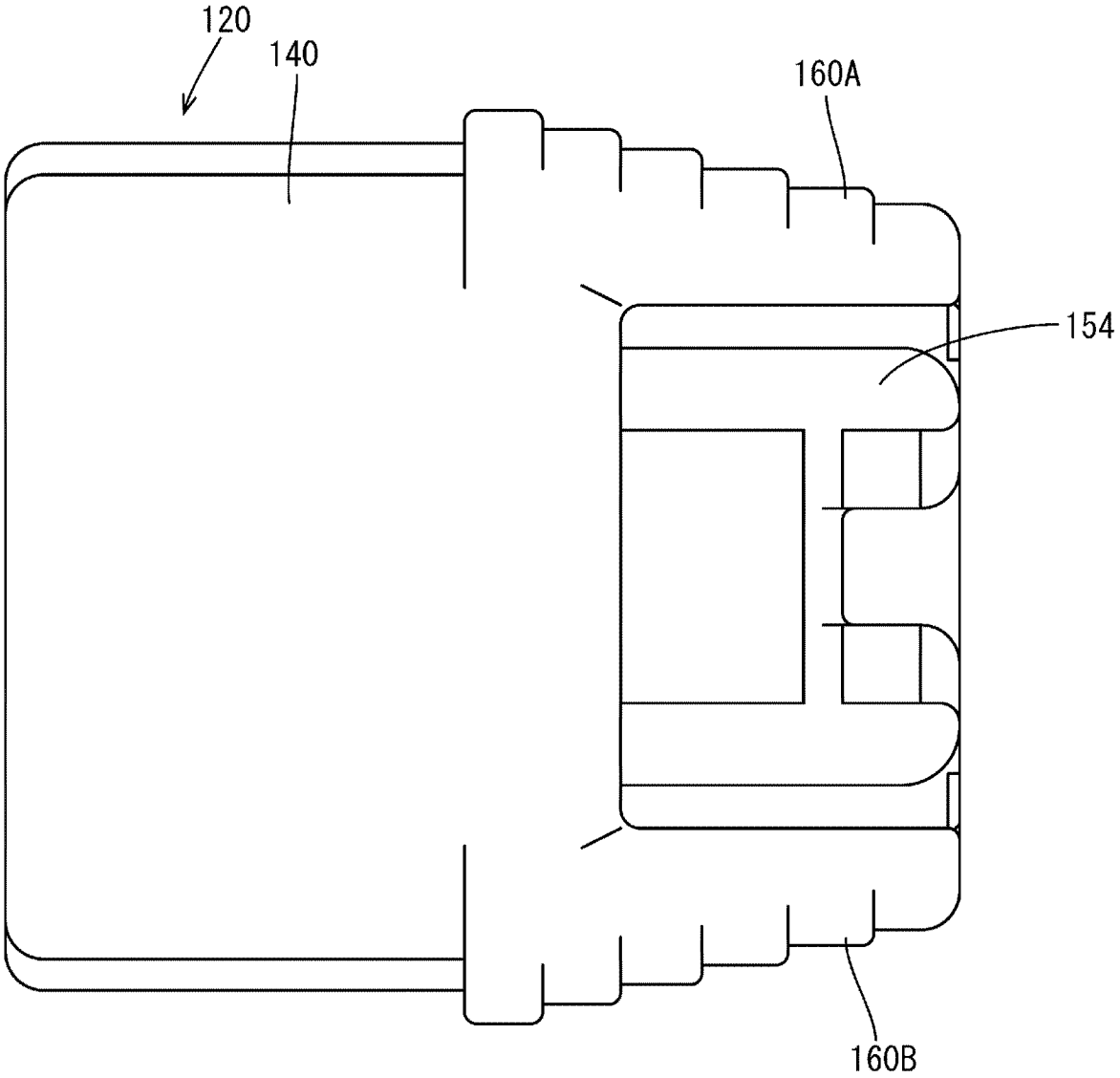
FIG. 19 is a bottom view of the housing of the female connector.
Figure 20:
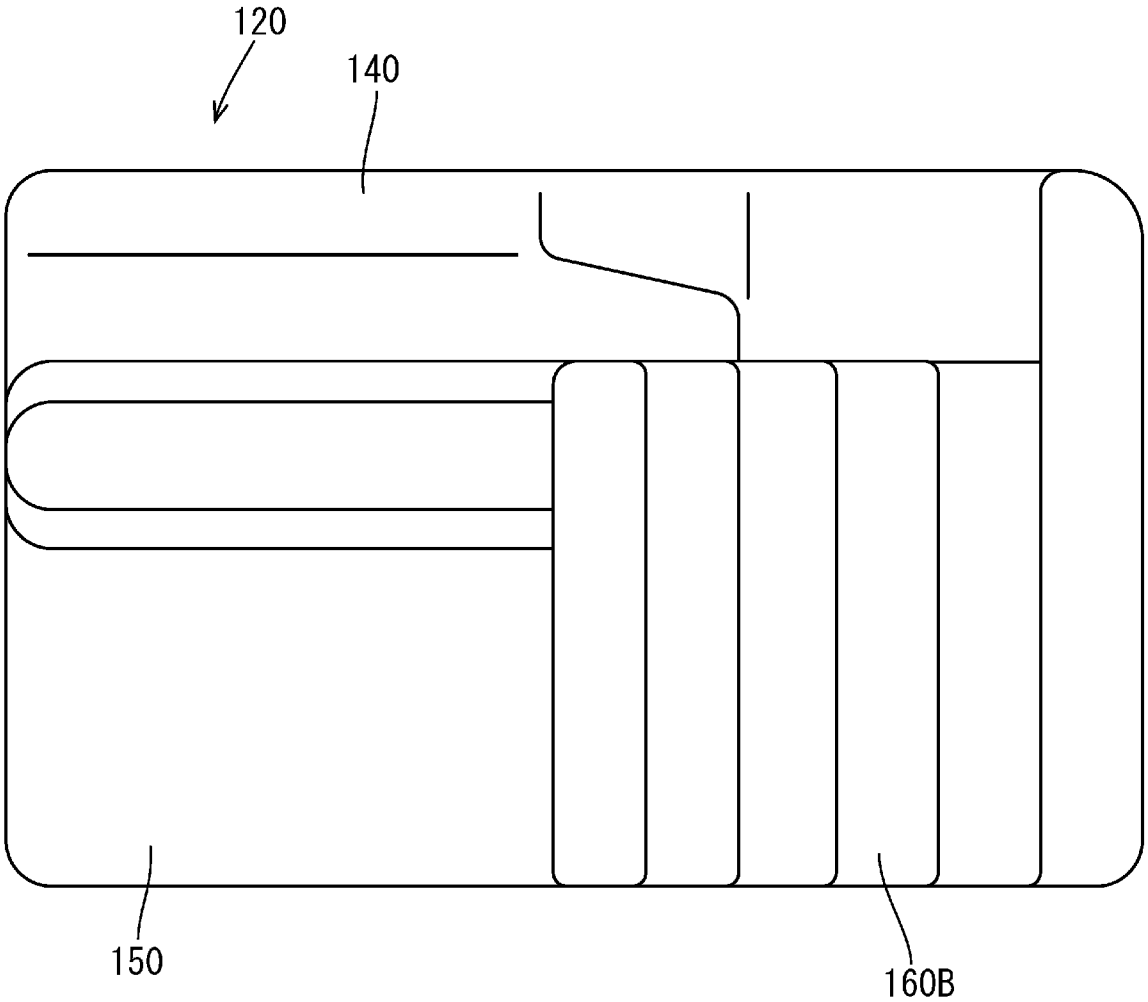
FIG. 20 is a side view showing the housing of the female connector.
Figure 21:
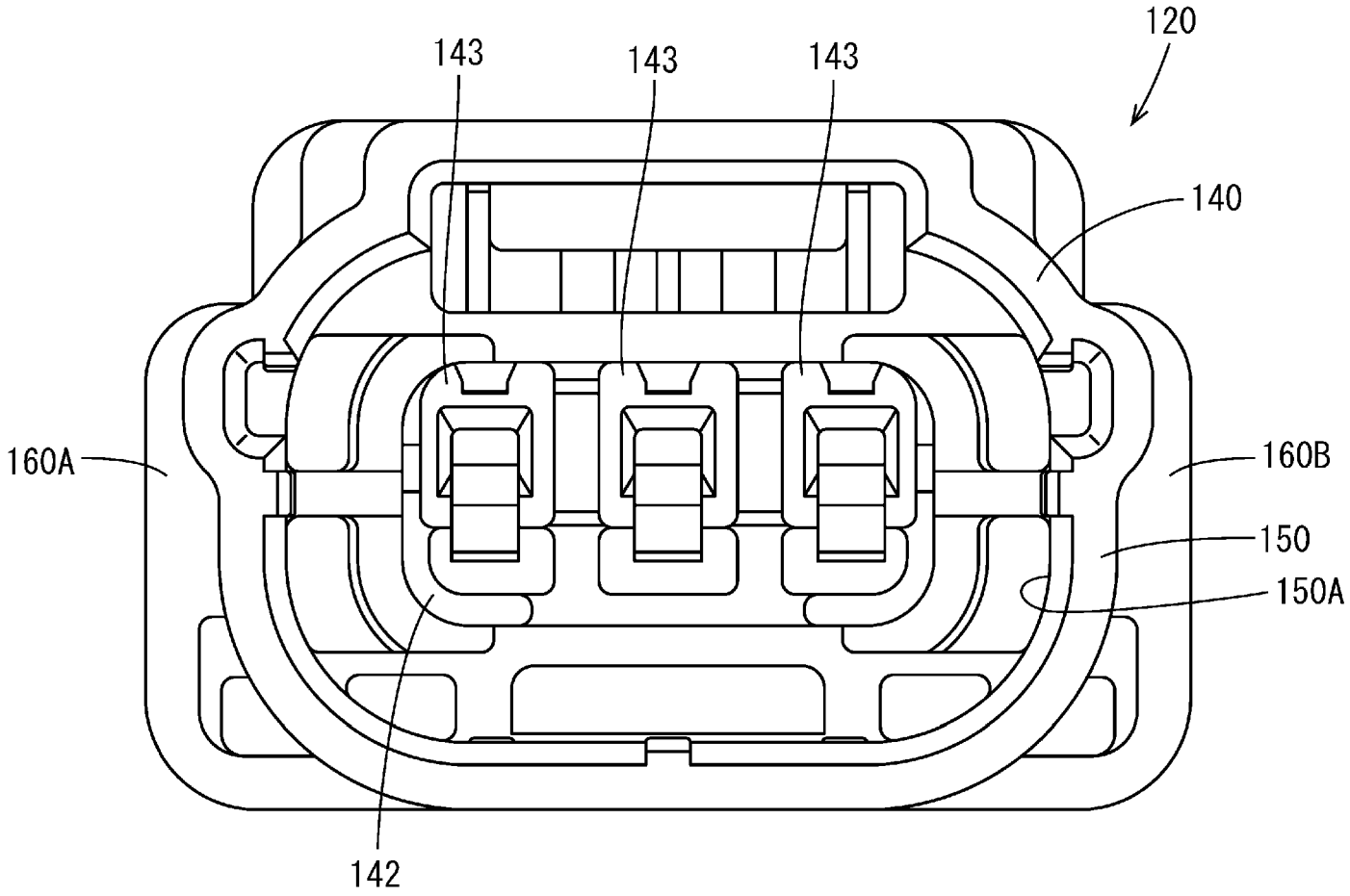
FIG. 21 is a front view showing the housing of the female connector.
Figure 22:
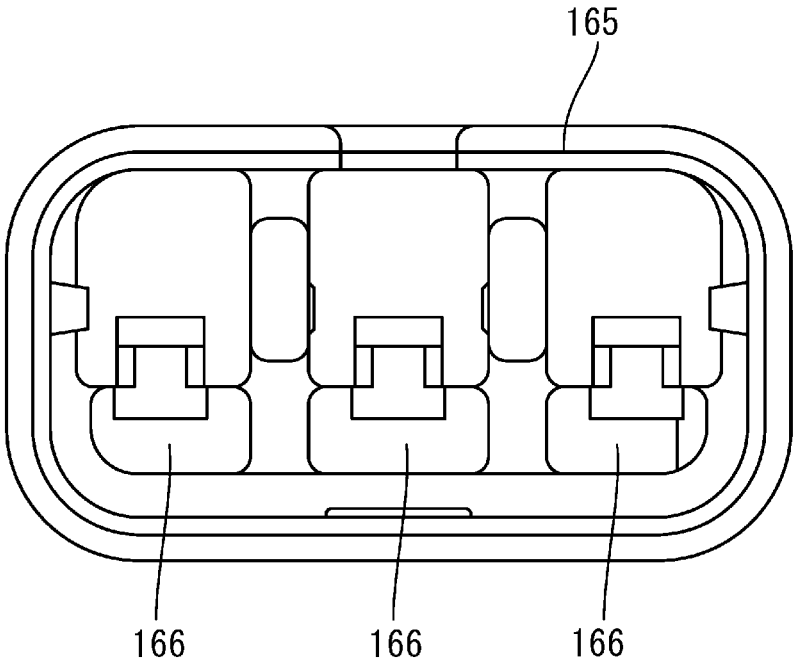
FIG. 22 is a back view showing a retainer.
Figure 23:
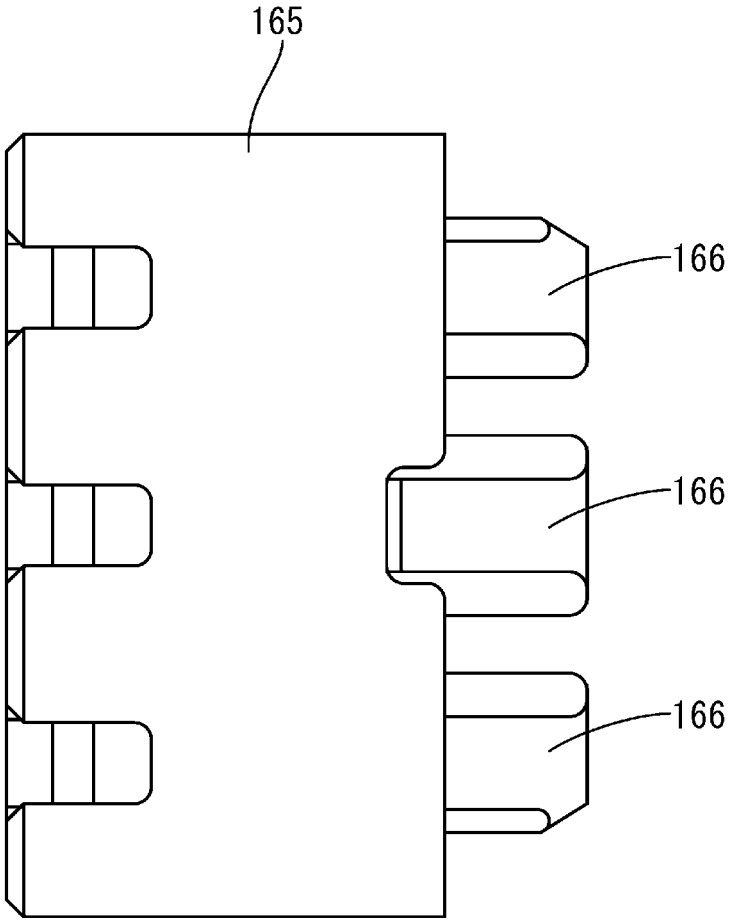
FIG. 23 is a plan view showing the retainer.
Figure 24:
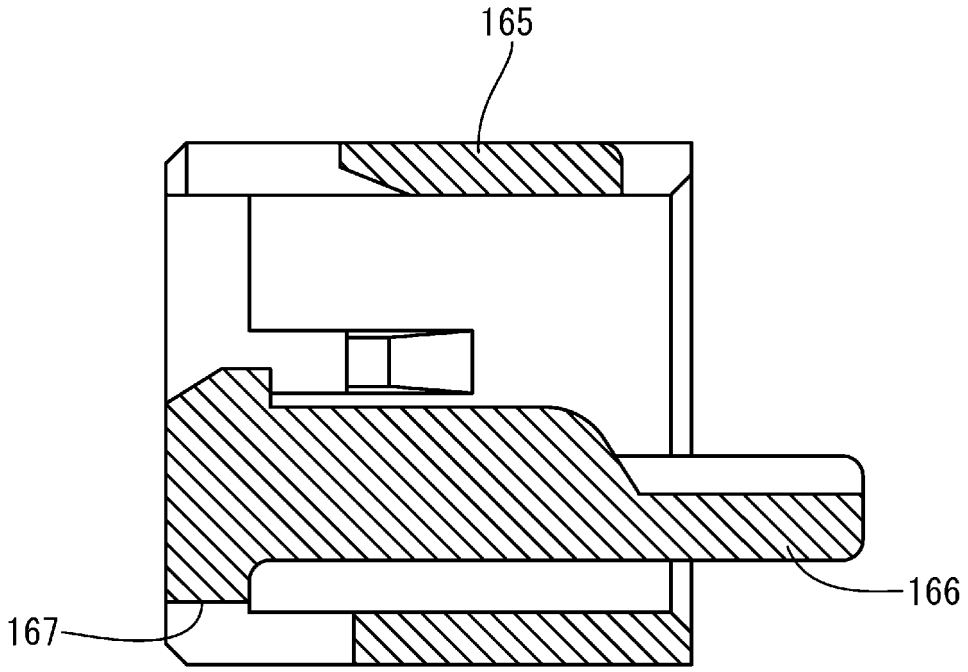
FIG. 24 is a section showing the retainer.
Figure 25:
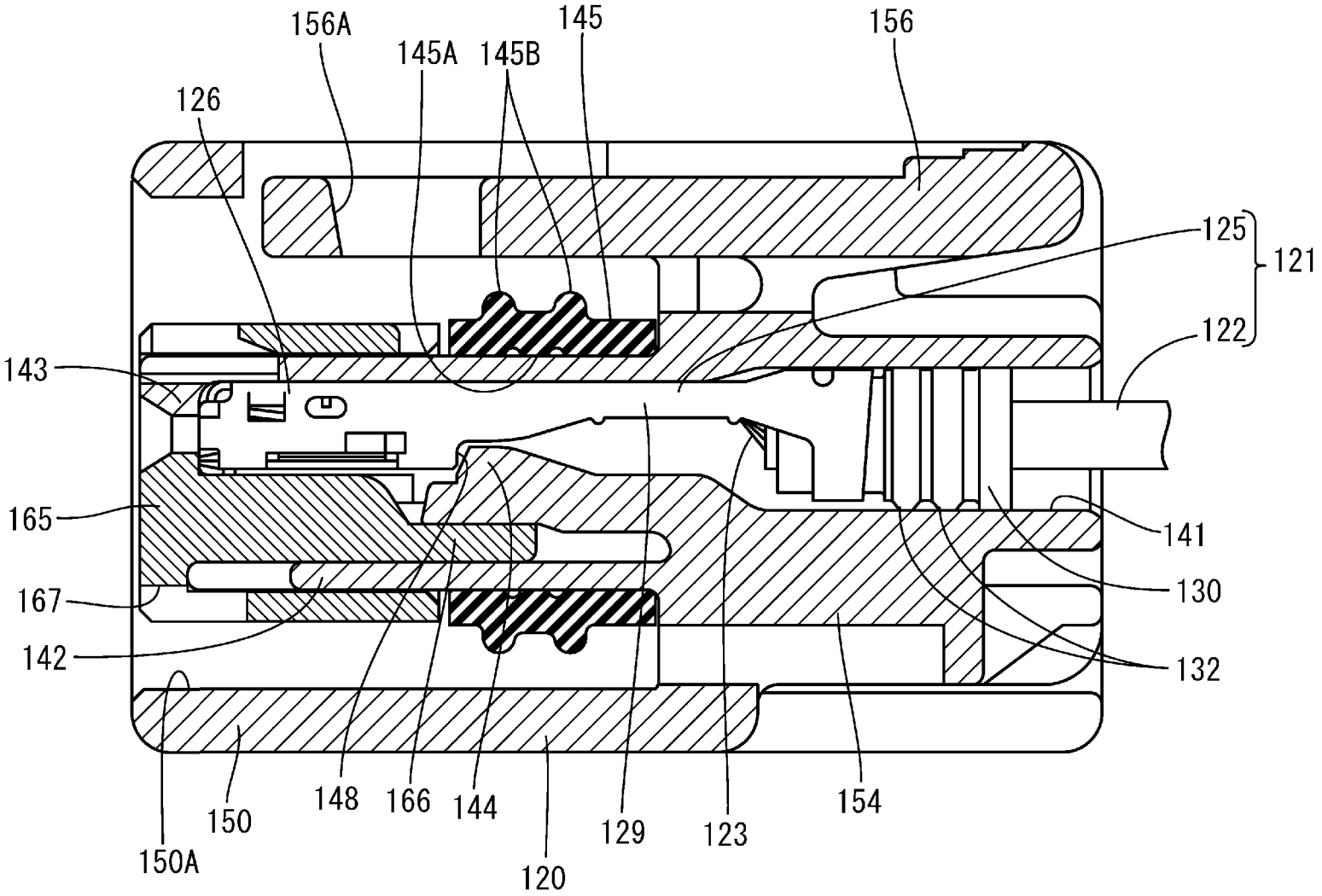
FIG. 25 is a section showing the female connector.
Figure 26:
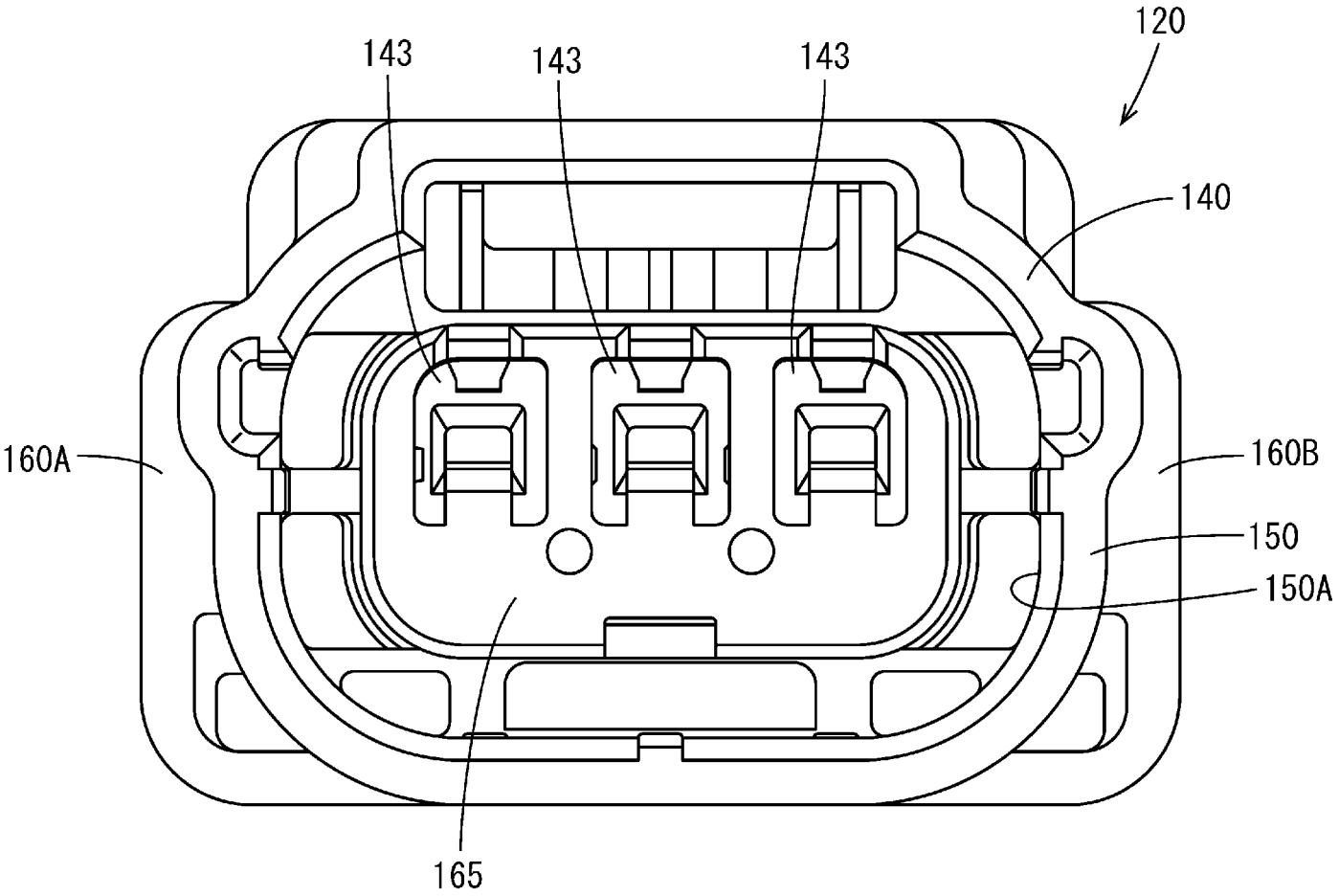
FIG. 26 is a front view showing the female connector.
Figure 27:
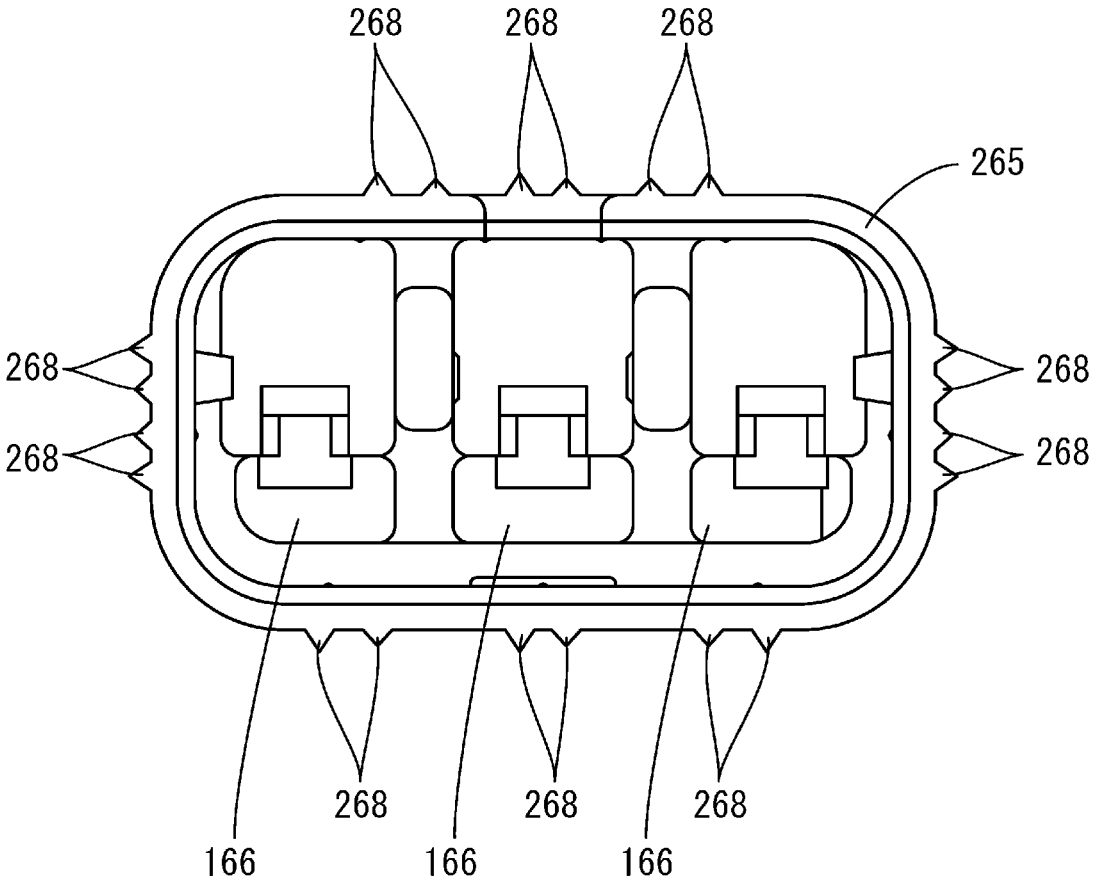
FIG. 27 is a back view showing a retainer according to Sample 2.
Figure 28:
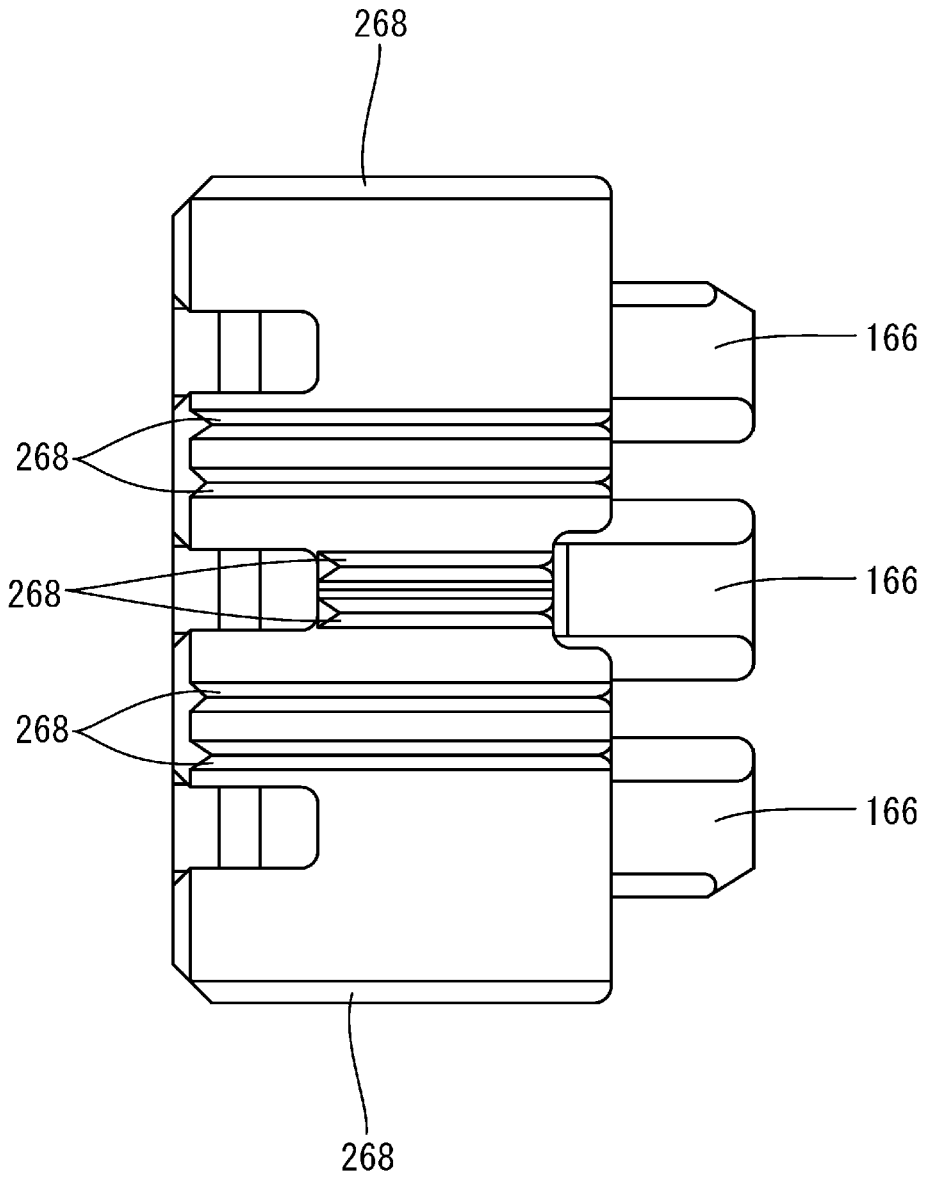
FIG. 28 is a plan view showing the retainer.
Figure 29:
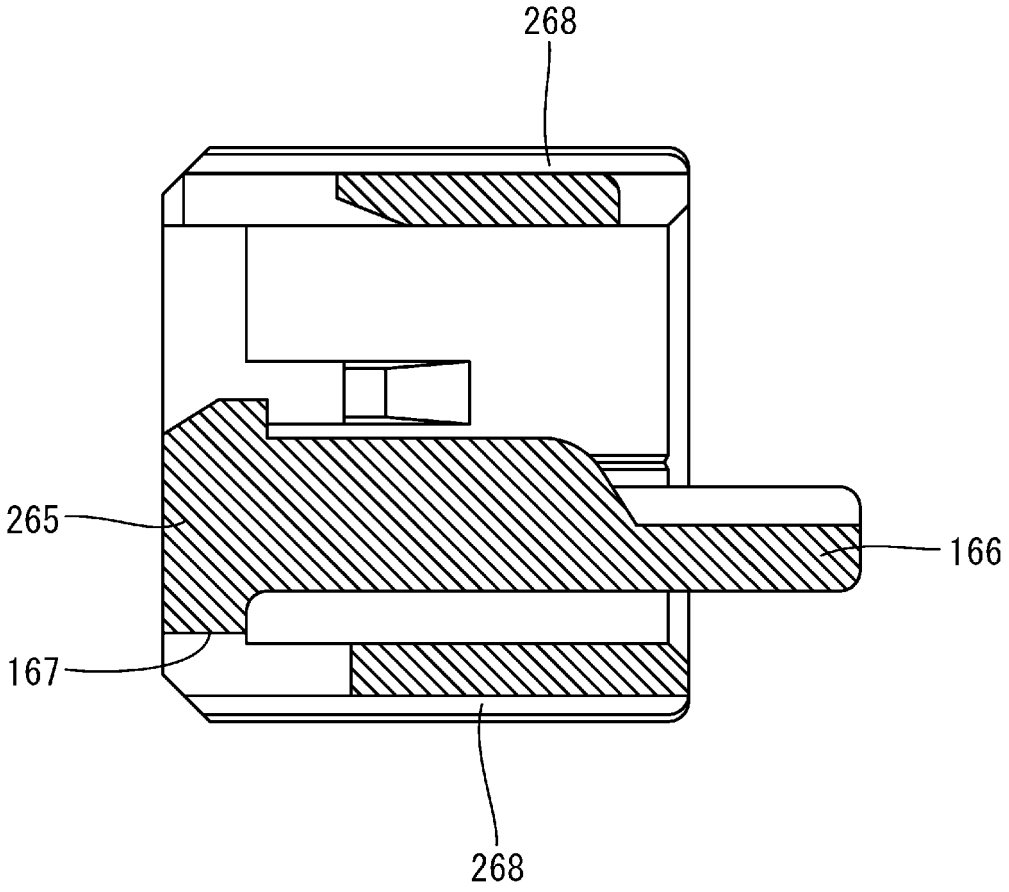
FIG. 29 is a section showing the retainer.
Figure 30:
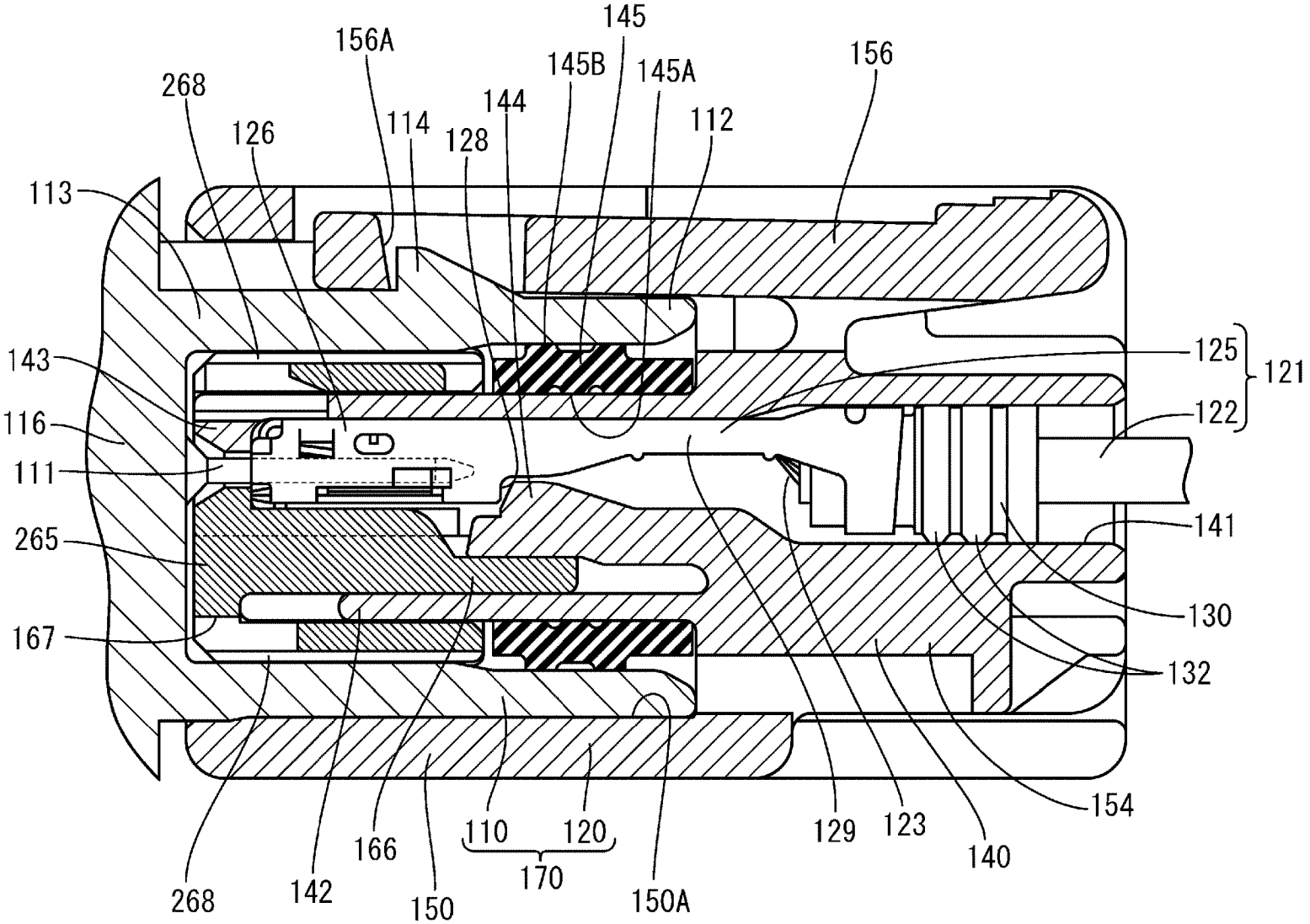
FIG. 30 is a section showing a connector according to Sample 2.
Figure 31:
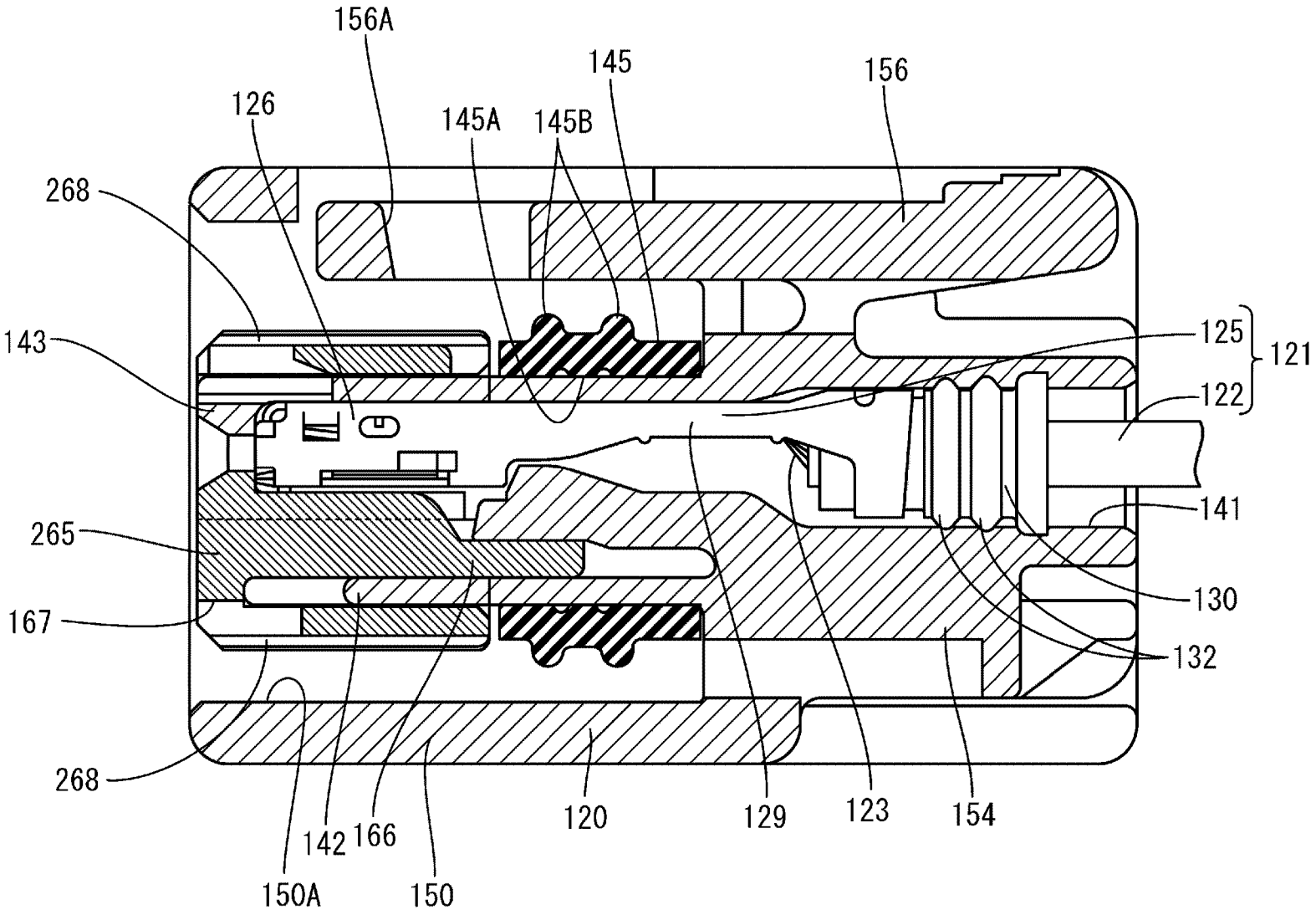
FIG. 31 is a section showing a female connector according to Sample 2.
Figure 32:
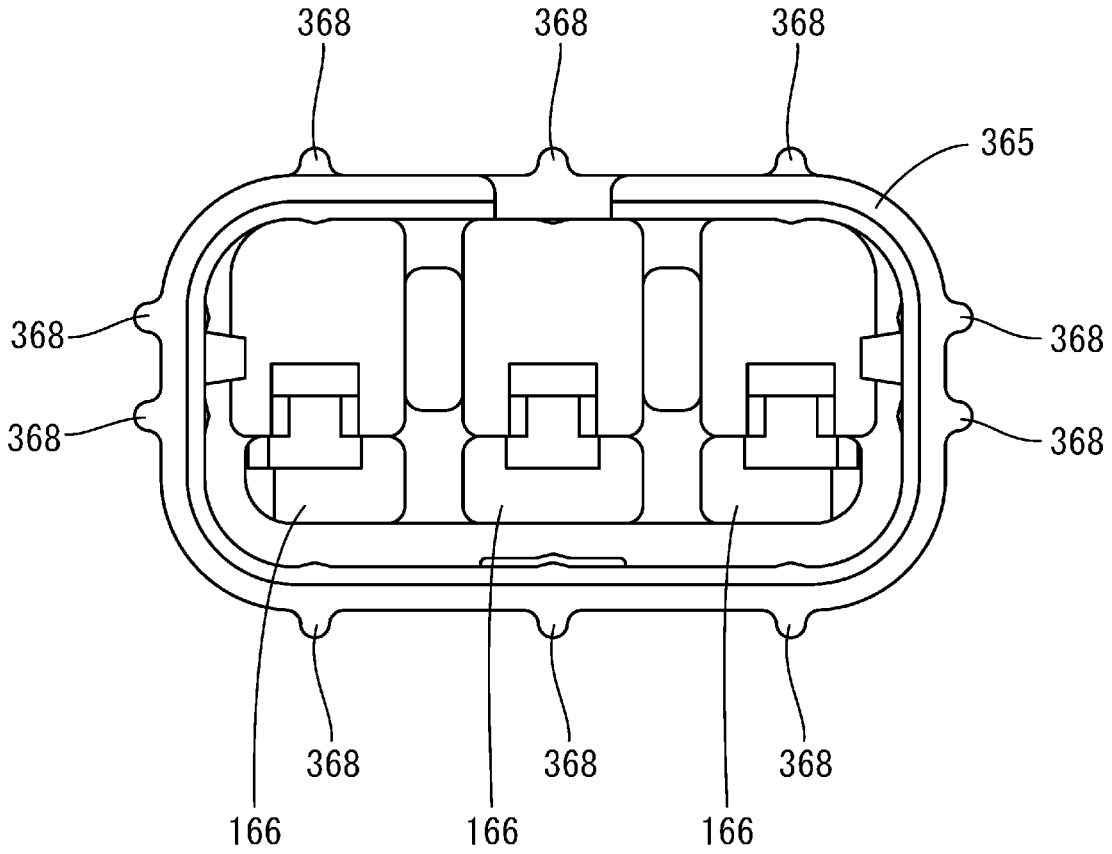
FIG. 32 is a back view showing a retainer according to Sample 3.
Figure 33:
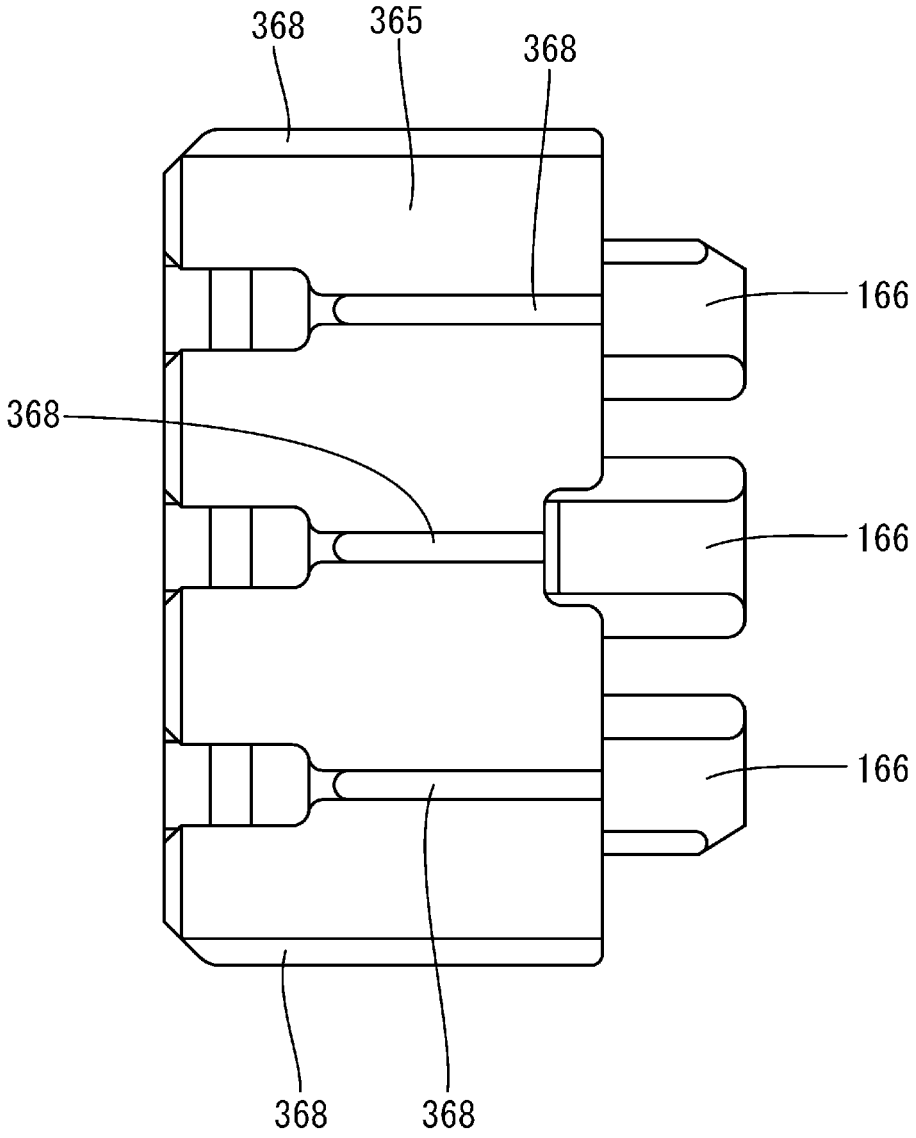
FIG. 33 is a plan view showing the retainer.
Figure 34:
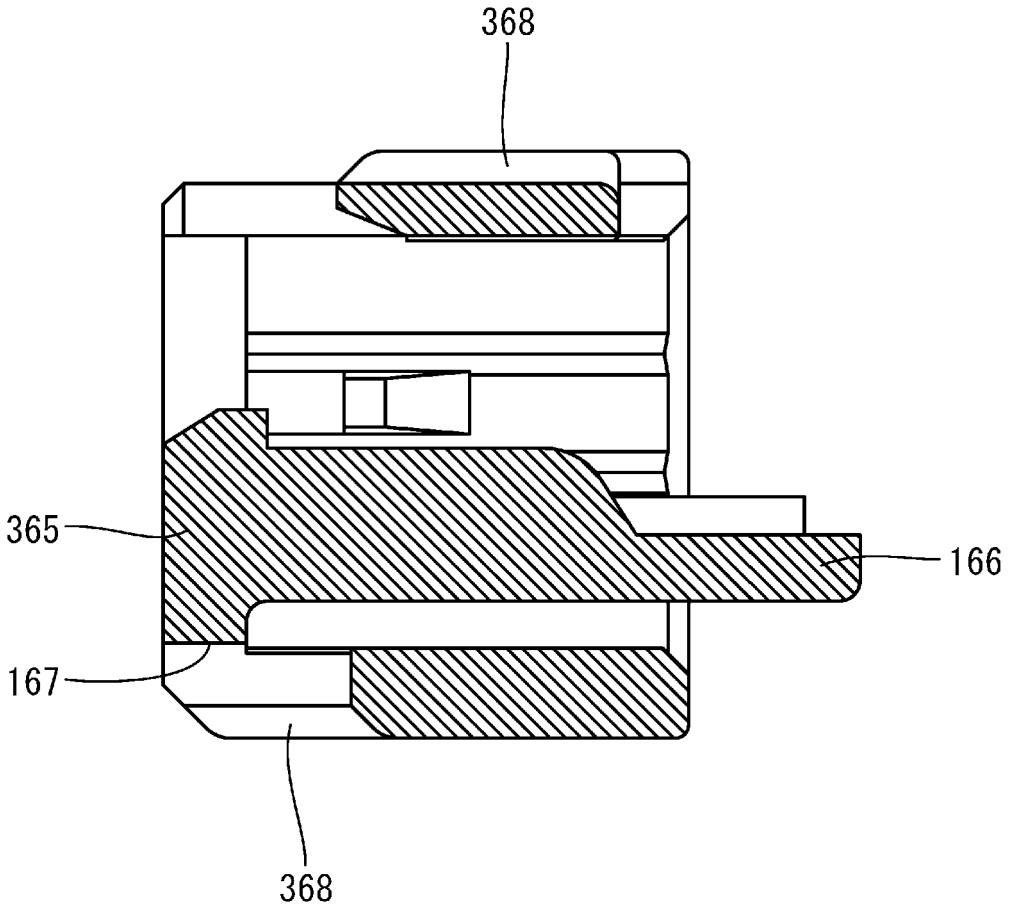
FIG. 34 is a section showing the retainer.
Figure 35:
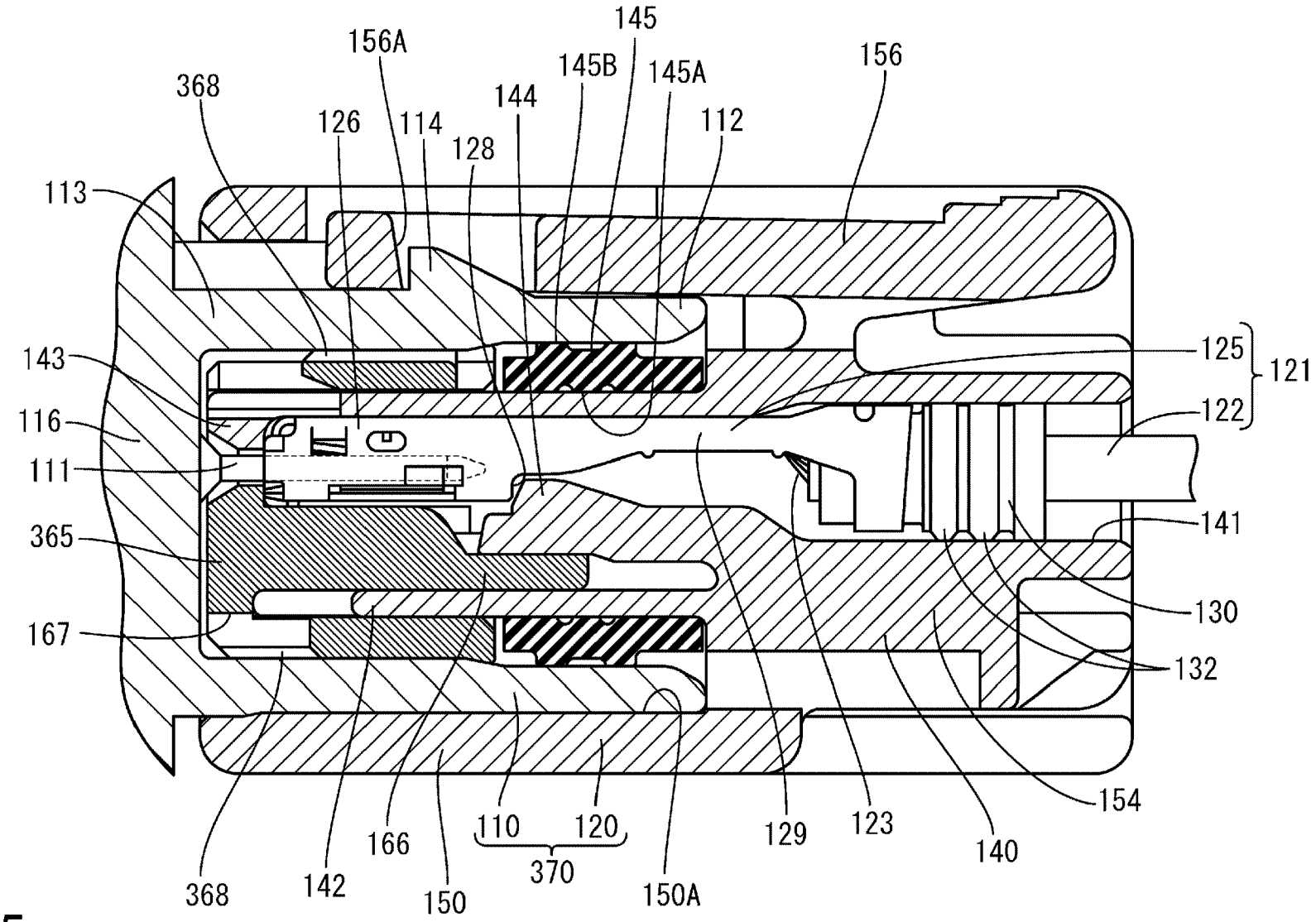
FIG. 35 is a section showing a connector according to Sample 3.
Figure 36:
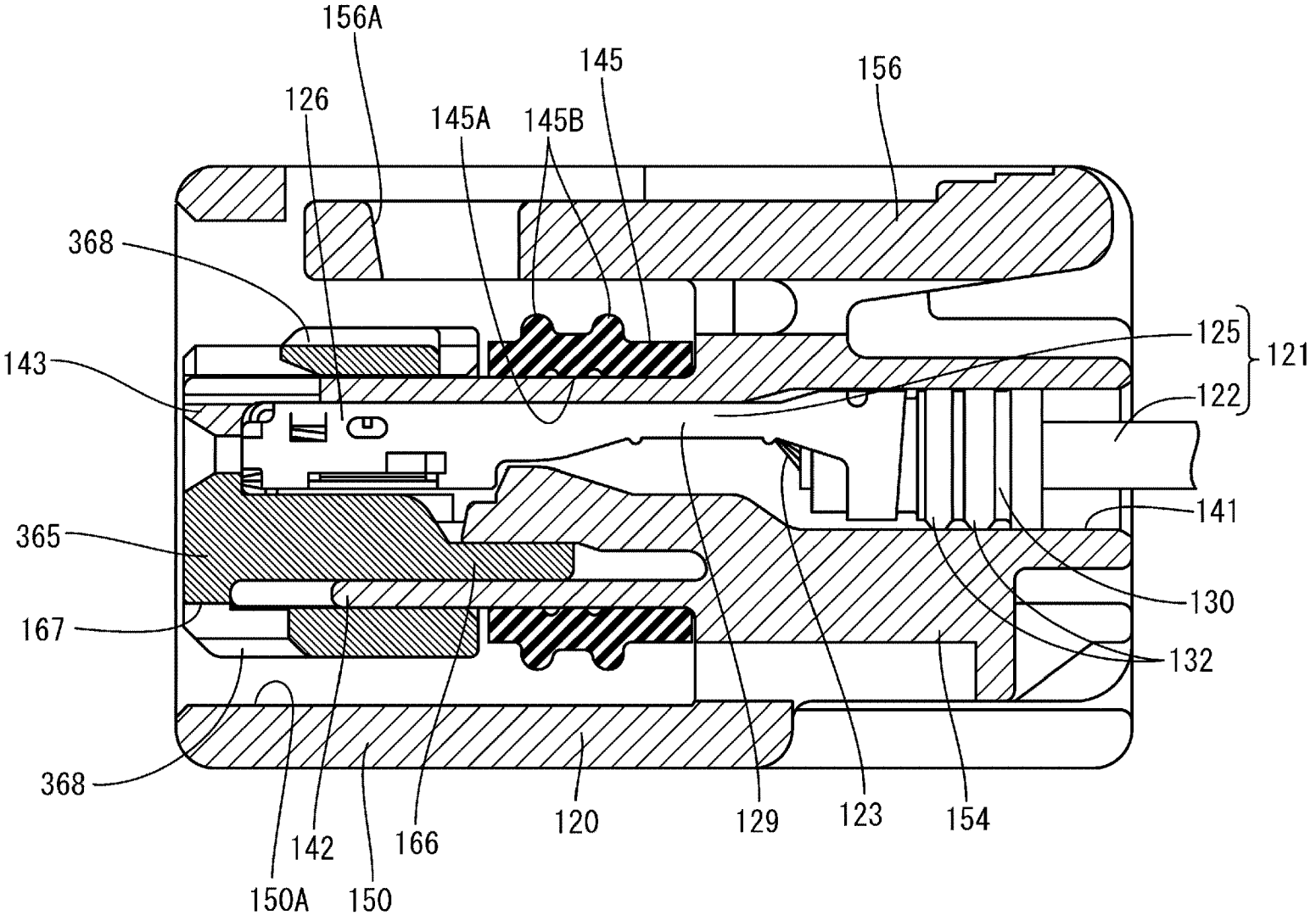
FIG. 36 is a section showing a female connector according to Sample 3.

As shown in FIG. 17, the female connector 120 includes a plurality of (three in Sample 1) terminal-provided wires 121, a housing 140 made of insulating synthetic resin for holding terminals 125 and a retainer 165 to be mounted on a front side of the housing 140. The housing 140 according to Sample 1 is made of polybutylene terephthalate.

A length of the housing 140 in the front-rear direction is about 25 mm, a width thereof in the lateral direction is about 22 mm and a height thereof in the vertical direction is about 15 mm.

Terminal-Provided Wires 121

The terminal-provided wire 121 is such that the terminal 125 is connected to an end part of a wire 122. The wire 122 is an insulated wire in which a conductor 123 is covered by an insulation coating 124, and the conductor 123 is, for example, a stranded wire formed by twisting a multitude of metal strands.

The terminal 125 includes a terminal connecting portion 126 to be connected to the male terminal 111 and a wire connecting portion 129 to be connected to the wire 122. The terminal connecting portion 126 is box-shaped and includes a resilient contact piece (not shown) folded inwardly from a tip part. The resilient contact piece resiliently contacts the male terminal 111 inserted into the terminal connecting portion 126. A rear part of the terminal connecting portion 126 is cut to form a cutout portion 128. The cutout portion 128 is locked to a locking lance 144 of the housing 140, whereby the terminal 125 is retained against a force in a withdrawing direction. The wire connecting portion 129 is crimped to the conductor 123 exposed at the end part of the wire 122.

A tubular rubber plug 130 is mounted on the wire 122. The rubber plug 130 is held in close contact with the insulation coating 124 of the wire 122 and formed with a wire insertion hole 131 penetrating in the front-rear direction. The wire 122 is inserted through the wire insertion hole 131. Wavy lip portions 132 extending in a circumferential direction are formed side by side in the front-rear direction on the outer periphery of the rubber plug 130. This rubber plug 130 seals between the wire 122 and the hole wall of an insertion hole 141 of the housing 140, thereby suppressing the intrusion of water and the like toward the terminal 125 through an opening of the insertion hole 141 of the housing 140.

Housing 140

The housing 140 is formed with a plurality of (three in Sample 1) insertion holes 141 penetrating in the front-rear direction. The terminal-provided wires 121 are inserted into the insertion holes 141 while being laterally arranged. The housing 140 includes a terminal accommodation chamber 142 for accommodating the terminals 125, an external fitting portion 150 covering the terminal accommodation chamber 142 from outside and projecting toward the receptacle 113 to be externally fit to the receptacle 113, a lead-out portion 154 disposed behind the terminal accommodation chamber 142, the wires 122 being led out from the lead-out portion 154, and protection walls 160A, 160B disposed at both left and right sides of the lead-out portion 154.

The terminal accommodation chamber 142 has a rectangular parallelepiped shape and a front end part thereof is cut to enable the insertion of the male terminals 111 and formed with a front stop portion 143 for restricting forward movements of the terminals 125. The cantilevered locking lance 144 extends forward from the hole wall of the insertion hole 141. The locking lance 144 is resiliently deformable and retains the terminal 125 by locking the cutout portion 128 of the terminal 125. A seal ring 145 is mounted on the outer periphery of the terminal accommodation chamber 142. The seal ring 145 is formed of a resiliently deformable material such as rubber, wavy lip portions 145A, 145B arranged side by side in the front-rear direction are circumferentially formed on inner and outer peripheries, and the outer surface of the seal ring 145 is held in close contact with the inner surface of the receptacle 113 when the both housings 112, 140 are connected.

A lock arm 156 extends in the front-rear direction on the upper surface of the housing 140. The lock arm 156 restricts the separation of the both connectors 110, 120 (both housings 112, 140) by having the lock protrusion 114 inserted into a lock hole 156A.

The external fitting portion 150 is in the form of a tube projecting forward and extends along the outer periphery of the receptacle 113. When the receptacle 113 of the male connector 110 is fit to the external fitting portion 150, an inner surface 150A of the external fitting portion 150 faces an outer side of the receptacle 113. In this way, the outer surface of the receptacle 113 is covered by the external fitting portion 150.

The lead-out portion 154 has a flat shape long in the lateral direction, and openings of three insertion holes 141 are arranged side by side in the lateral direction inside the lead-out portion 154. The rubber plug 130 having the wire 122 inserted therethrough is held in close contact with the inner wall of each insertion hole 141 of the lead-out portion 154. The lock arm 156 extends forward from the upper surface of the lead-out portion 154.

The protection walls 160A, 160B have a stepped tapered shape when viewed from above. A pair of left and right protection walls 160A, 160B extend in parallel to each other and are formed to be flush with the rear end edge of the lead-out portion 154.

The retainer 165 is made of synthetic resin and mounted on the front side of the housing 140, and includes a deflection restricting piece 166 for restricting the deflection of the locking lances 144 by entering between the locking lances 144 and the inner wall of the terminal accommodating portion 142. Further, a front end side of the retainer 165 is open so that the male terminals 111 are insertable. A cutout portion 167 is formed in the lower end edge of a front end part of the retainer 165. The retainer 165 is made of polybutylene terephthalate.

Sample 2

Next, the configuration of a connector 270 according to Sample 2 is described with reference to FIGS. 27 to 31. Since Sample 2 is different from Sample 1 only in configuration relating to a retainer 265, the same members are denoted by the same reference signs and repeated description is omitted.

A plurality of ribs 268 projecting outward and extending in the front-rear direction are formed on the outer peripheral surface of the retainer 265. Six ribs 268 are formed on each of the upper and lower surfaces of the retainer 265 while being spaced apart in the lateral direction. The six ribs 268 are composed of three pairs of the ribs 268 spaced apart in the lateral direction, and each pair of the ribs 268 are spaced apart in the lateral direction. Further, four ribs 268 are formed on each of the left and right side surfaces of the retainer 265 while being spaced apart in the vertical direction. These ribs 268 come into contact with the inner surface of a receptacle 113 to be squeezed, whereby rigidity when a male connector 110 and a female connector 120 are connected is improved.

Sample 3

The configuration of a connector 370 according to Sample 3 is described with reference to FIGS. 32 to 36. Since Sample 3 is different from Sample 1 only in configuration relating to a retainer 365, the same members are denoted by the same reference signs and repeated description is omitted.

A plurality of ribs 368 projecting outward and extending in the front-rear direction are formed on the outer peripheral surface of the retainer 365. Three ribs 368 are formed on each of the upper and lower surfaces of the retainer 365 while being spaced apart in the lateral direction. Further, two ribs 368 are formed on each of the left and right side surfaces of the retainer 365 while being spaced apart in the vertical direction. These ribs 368 come into contact with the inner surface of a receptacle 113 to be squeezed, whereby rigidity when a male connector 110 and a female connector 120 are connected is improved.

Sample 4

In a connector according to Sample 4, a housing of a female connector is made of a material containing 15 parts by mass of glass fiber based on 100 parts by mass of polybutylene terephthalate. Since the other configuration is the same as in Sample 1, repeated description is omitted.

Sample 5

In a connector according to Sample 5, a housing of a female connector is made of a material containing 15 parts by mass of glass fiber based on 100 parts by mass of polybutylene terephthalate. Since the other configuration is the same as in Sample 3, repeated description is omitted.

Sample 6

Figure 37:
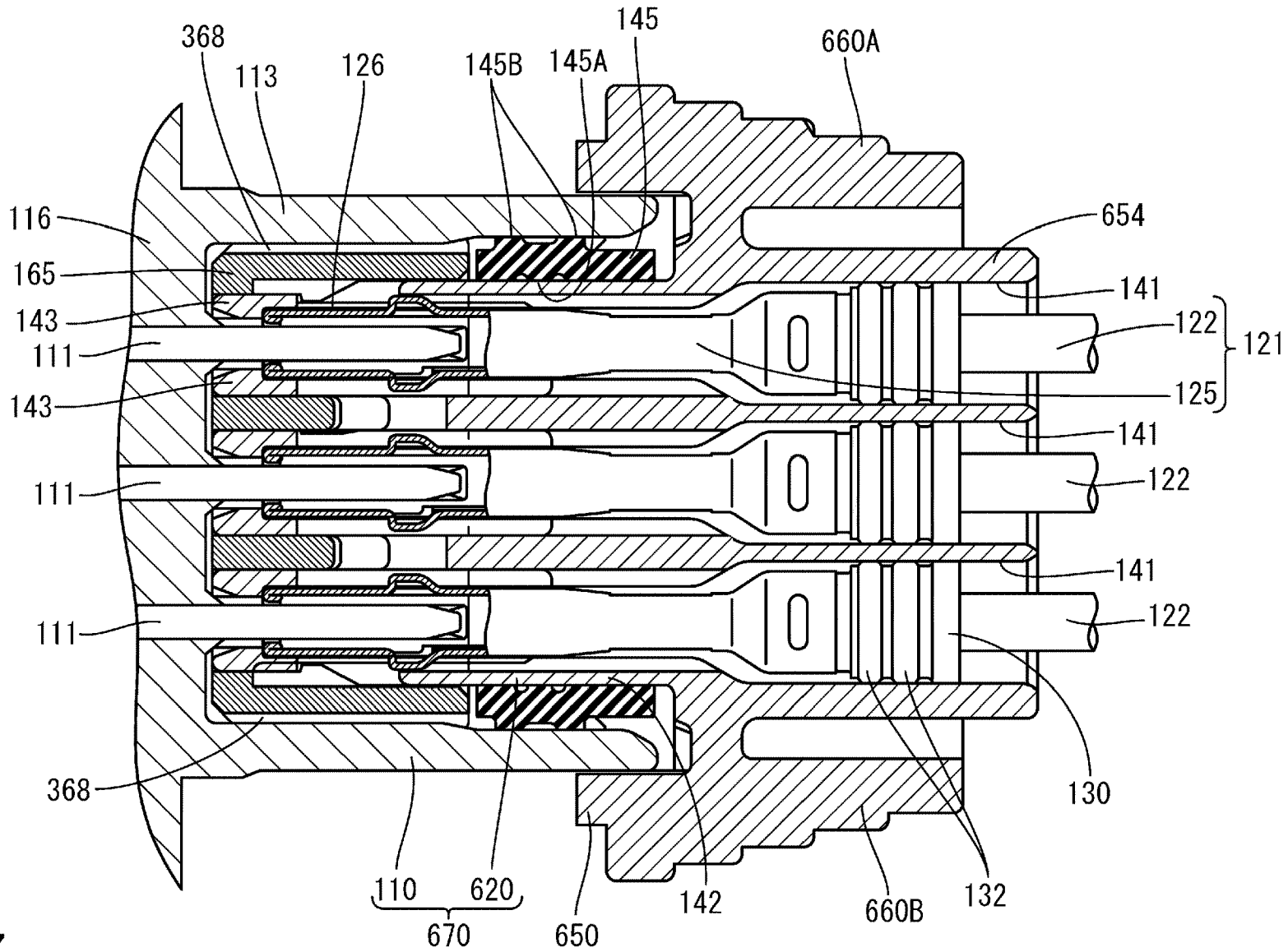
FIG. 37 is a section showing a connector according to Sample 6.
Figure 38:
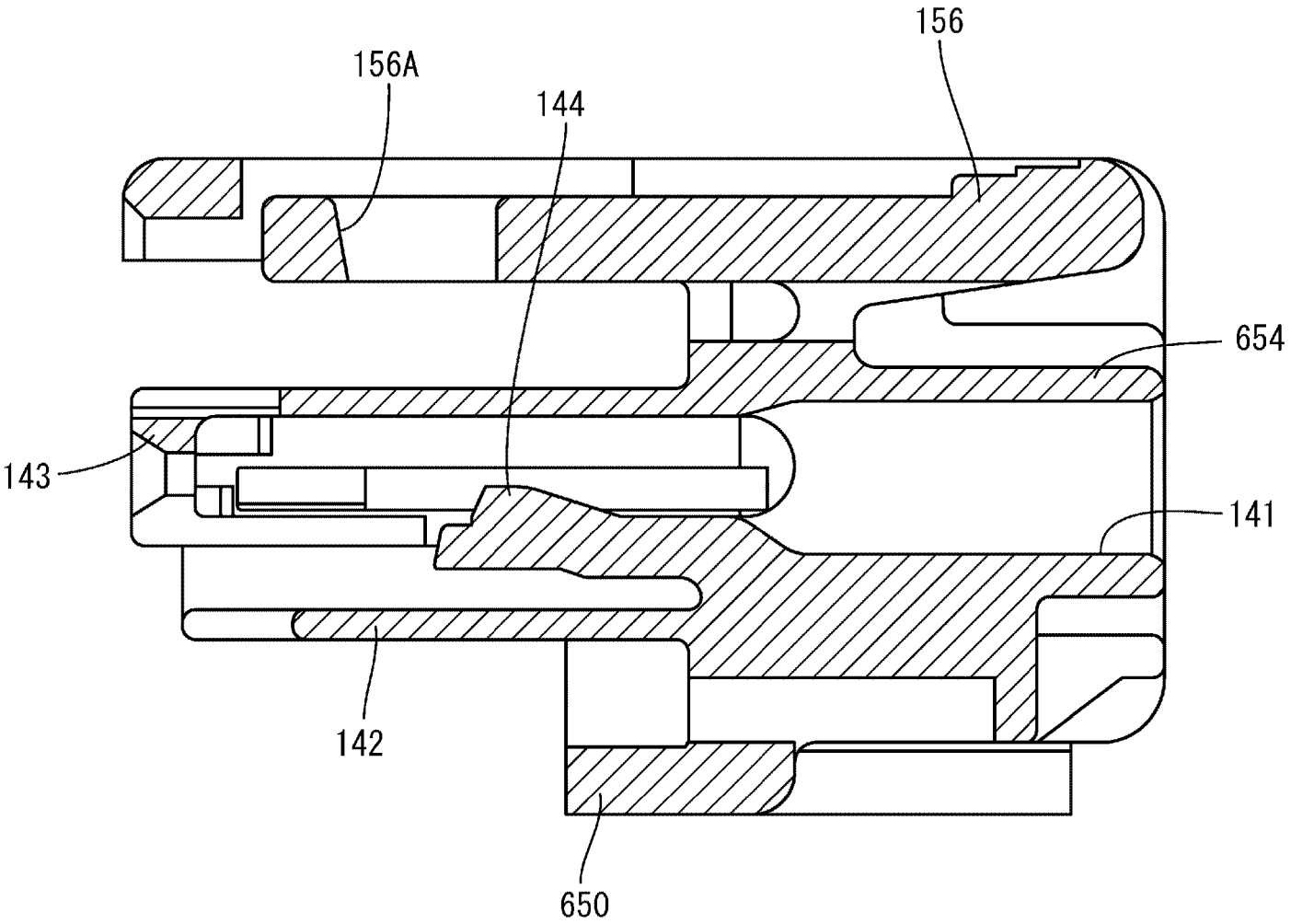
FIG. 38 is a section showing a housing of a female connector according to Sample 6.

The configuration of a connector 670 according to Sample 6 is described with reference to FIGS. 37 and 38. Since the connector 670 according to Sample 6 has substantially the same configuration as the connector 370 according to Sample 3 except in a housing 640 of a female connector 620, the same members are denoted by the same reference signs and repeated description is omitted.

The rear end edges of protection walls 660A, 660B provided on the housing 640 are cut. Thus, the rear end edge of a lead-out portion 654 projects rearward from the rear end edges of the protection walls 660A, 660B.

Further, an external fitting portion 650 provided on the housing 640 is cut, leaving a base end part. Thus, most of a terminal accommodation chamber 642 is exposed from the external fitting portion 650 in the housing 640. The outer surface of a tip part of a receptacle 113 is covered by the external fitting portion 650 and a base end side (front side) of the receptacle 113 is exposed without being covered by the external fitting portion 650.

Sample 7

In a connector according to Sample 7, a housing of a female connector is made of a material containing 15 parts by mass of glass fiber based on 100 parts by mass of polybutylene terephthalate. Since the other configuration is the same as in Sample 6, repeated description is omitted.

Sample 8

The configuration of a connector 870 according to Sample 8 is described with reference to FIGS. 39 to 41. The connector 870 according to Sample 8 includes a male connector 810 and a female connector 820.

Male Connector 810

Figure 39:
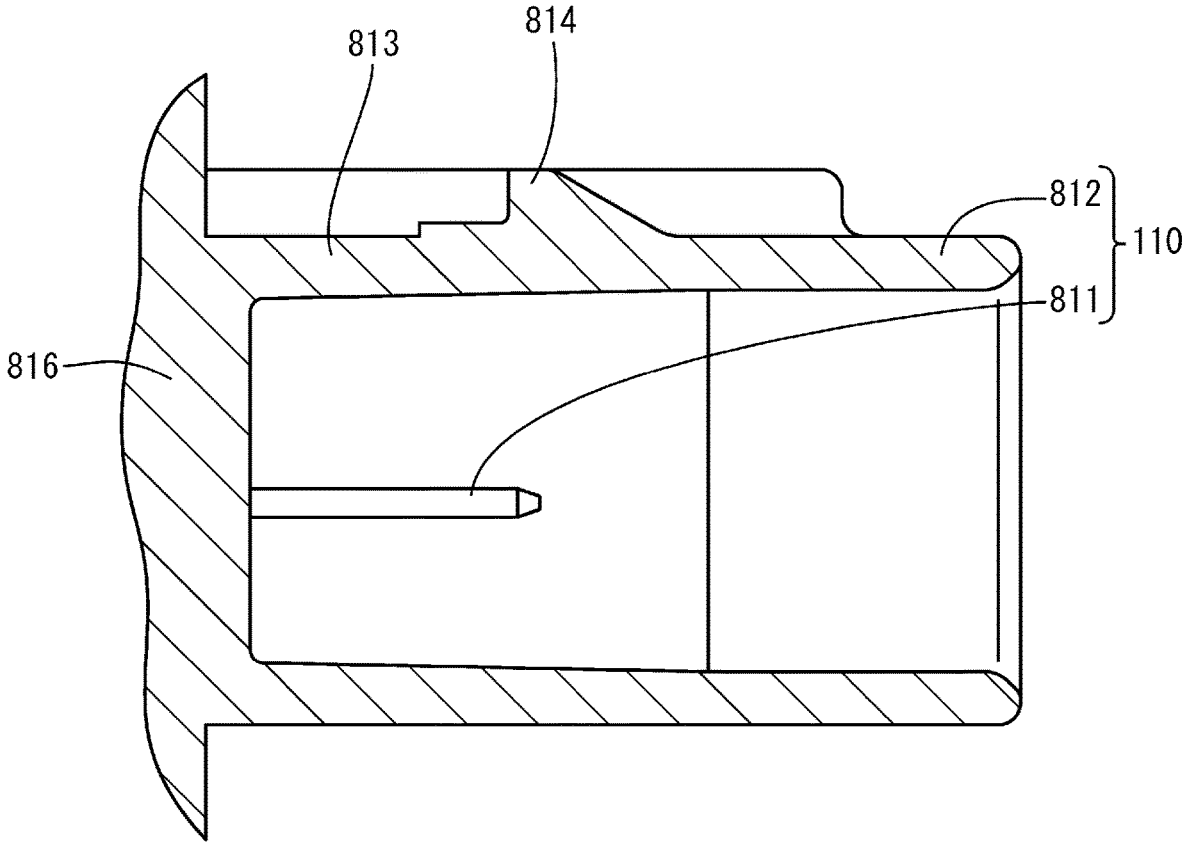
FIG. 39 is a section showing a male connector according to Sample 8.

As shown in FIG. 39, the male connector 810 includes male terminals 811 and a male housing 812 made of insulating synthetic resin for holding the male terminals 811. The housing 812 according to Sample 8 is made of polybutylene terephthalate. The male housing 812 includes an open receptacle 813 and a back wall portion 816 closing the receptacle 813. The male terminals 811 project into the receptacle 813 through the back wall portion 816.

The receptacle 813 is in the form of an elliptical tube long in the lateral direction and a lock protrusion 814 projects upward in a step-like manner on the top of the outer surface of the receptacle 813.

Female Connector 820

Figure 40:
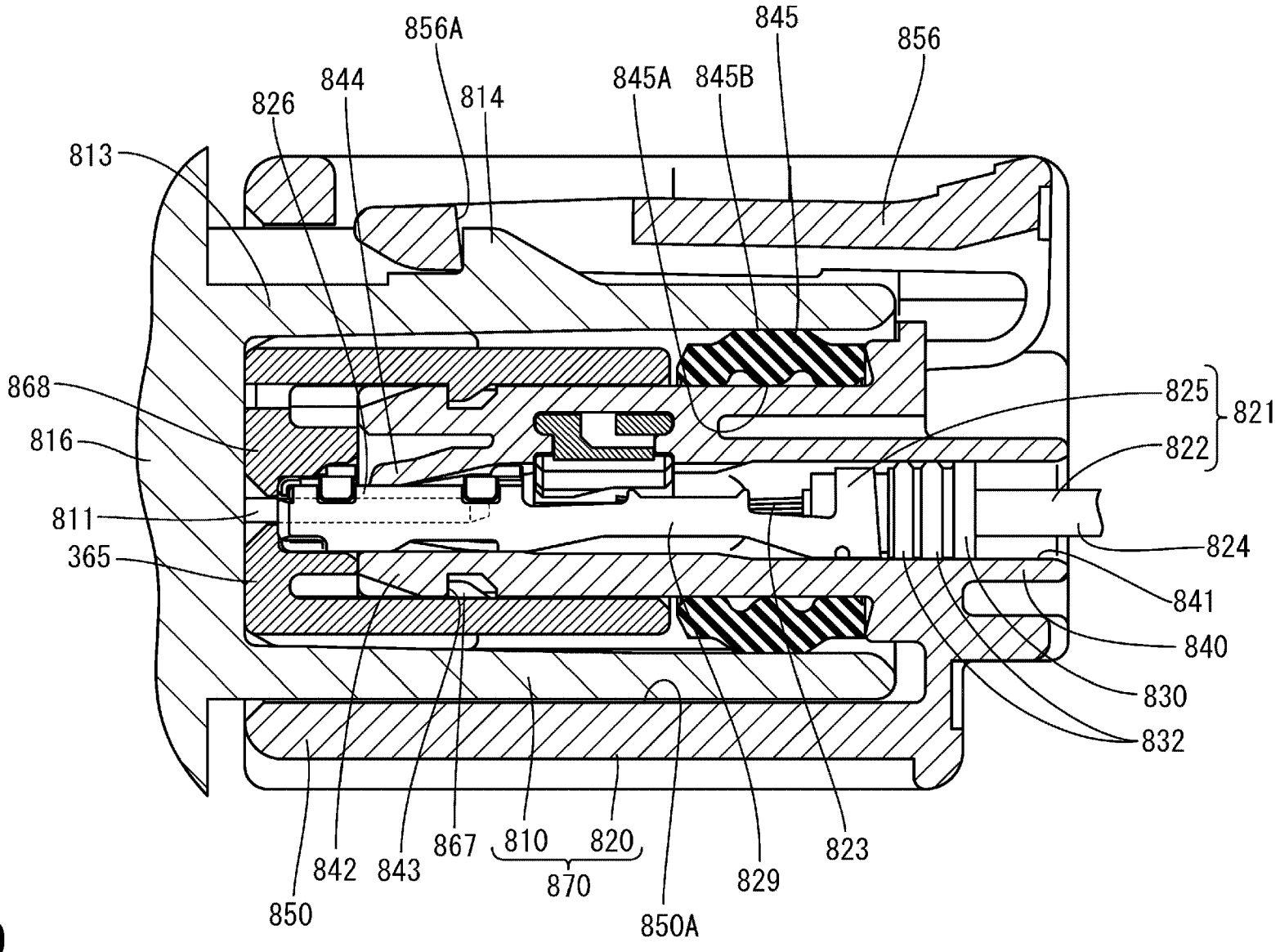
FIG. 40 is a section showing a connector according to Sample 8.
Figure 41:
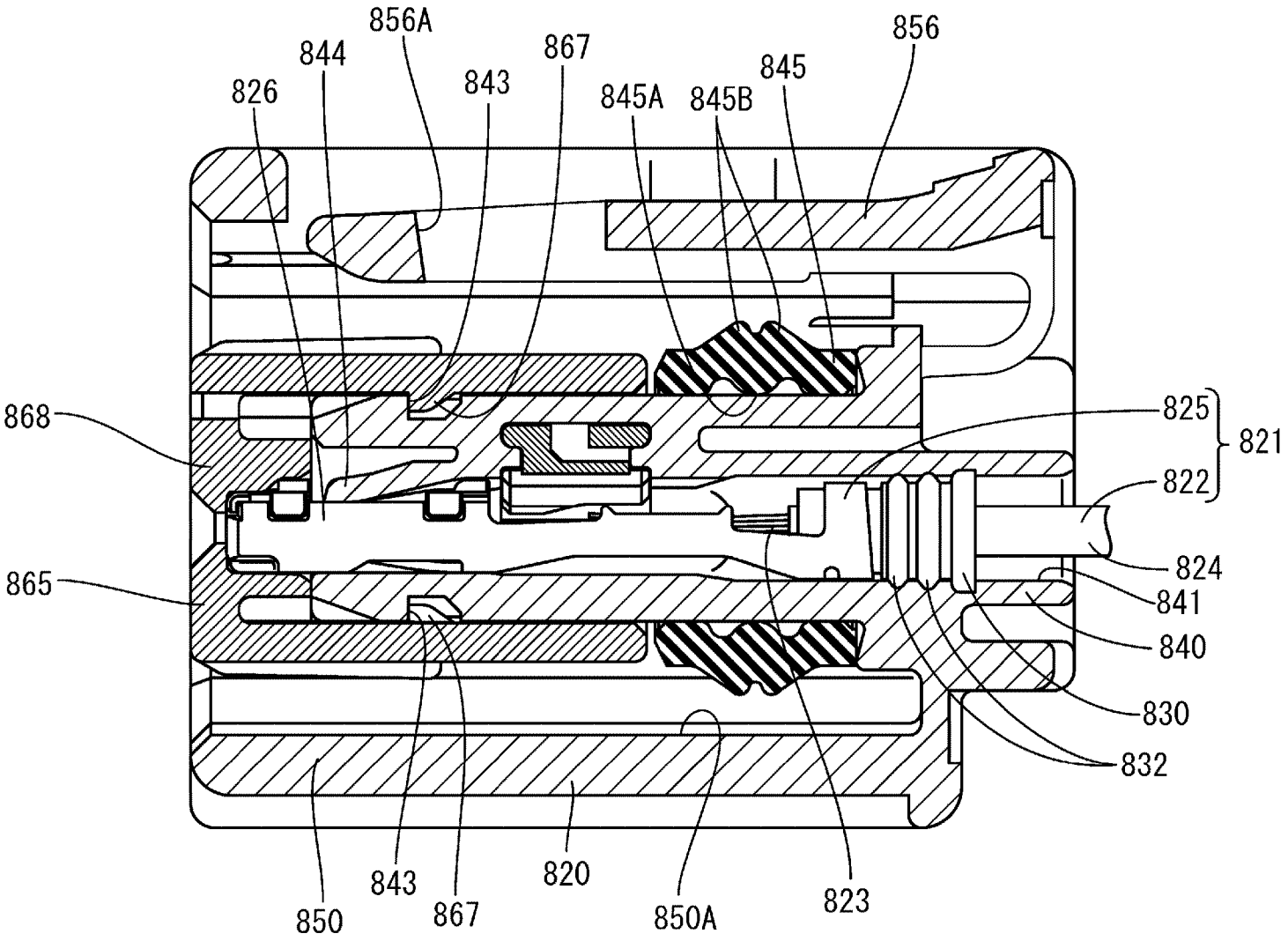
FIG. 41 is a section showing a female connector according to Sample 8.

As shown in FIG. 40, the female connector 820 includes a plurality of (three in Sample 8) terminal-provided wires 821, a housing 840 made of insulating synthetic resin for holding terminals 825 and a retainer 865 to be mounted on a front side of the housing 840. The housing 840 according to Sample 8 is made of polybutylene terephthalate.

A length of the housing 840 in the front-rear direction is about 22 mm, a width thereof in the lateral direction is about 17 mm and a height thereof in the vertical direction is about 17 mm.

Terminal-Provided Wires 821

The terminal-provided wire 821 is such that the terminal 825 is connected to an end part of a wire 822. The wire 822 is an insulated wire in which a conductor 823 is covered by an insulation coating 824, and the conductor 823 is, for example, a stranded wire formed by twisting a multitude of metal strands.

The terminal 825 includes a terminal connecting portion 826 to be connected to the male terminal 811 and a wire connecting portion 829 to be connected to the wire 822. The terminal connecting portion 826 is box-shaped and includes a resilient contact piece (not shown) folded inwardly from a tip part. The resilient contact piece resiliently contacts the male terminal 811 inserted into the terminal connecting portion 826. The terminal connecting portion 826 is formed with an unillustrated locking hole. A hole edge part of the locking hole is locked to a locking lance 844 of the housing 840, whereby the terminal 825 is retained against a force in a withdrawing direction. The wire connecting portion 829 is crimped to the conductor 823 exposed at the end part of the wire 822.

A tubular rubber plug 830 is mounted on the wire 822. The rubber plug 830 is held in close contact with the insulation coating 824 of the wire 822 and formed with a wire insertion hole (not shown) penetrating in the front-rear direction. The wire 822 is inserted through the wire insertion hole. Wavy lip portions 832 extending in a circumferential direction are formed side by side in the front-rear direction on the outer periphery of the rubber plug 830. This rubber plug 830 seals between the wire 822 and the hole wall of an insertion hole 841 of the housing 840, thereby suppressing the intrusion of water and the like toward the terminal 825 through an opening of the insertion hole 841 of the housing 840.

Housing 840

The housing 840 is formed with a plurality of (three in Sample 8) insertion holes 841 penetrating in the front-rear direction. The terminal-provided wires 821 are inserted into the insertion holes 841 while being laterally arranged. The housing 840 includes a terminal accommodation chamber 842 for accommodating the terminals 825, an external fitting portion 850 covering the terminal accommodation chamber 842 from outside and projecting toward the receptacle 813 to be externally fit to the receptacle 813, and a lead-out portion 854 disposed behind the terminal accommodation chamber 842, the wires 822 being led out from the lead-out portion 854.

The terminal accommodation chamber 842 has a rectangular parallelepiped shape and a front end part thereof is cut to enable the insertion of the male terminals 811. The cantilevered locking lance 844 extends forward from the hole wall of the insertion hole 841. The locking lance 844 is resiliently deformable and retains the terminal 825 by locking the hole edge part of the locking hole of the terminal 825. A seal ring 845 is mounted on the outer periphery of the terminal accommodation chamber 842. The seal ring 845 is formed of a resiliently deformable material such as rubber, wavy lip portions 845A, 845B arranged side by side in the front-rear direction are circumferentially formed on inner and outer peripheries, and the outer surface of the seal ring 845 is held in close contact with the inner surface of the receptacle 813 when the both housings 812, 840 are connected.

A lock arm 856 extends in the front-rear direction on the upper surface of the housing 840. The lock arm 856 restricts the separation of the both connectors 810, 820 (both housings 812, 840) by having the lock protrusion 814 inserted into a lock hole 856A.

The external fitting portion 850 is in the form of a tube projecting forward and extends along the outer periphery of the receptacle 813. When the receptacle 813 of the male connector 810 is fit to the external fitting portion 850, an inner surface 850A of the external fitting portion 850 faces an outer side of the receptacle 813. In this way, the outer surface of the receptacle 813 is covered by the external fitting portion 850.

The lead-out portion 854 has a flat shape long in the lateral direction, and openings of three insertion holes 841 are arranged side by side in the lateral direction inside the lead-out portion 854. The rubber plug 830 having the wire 822 inserted therethrough is held in close contact with the inner wall of each insertion hole 841 of the lead-out portion 854. The lock arm 856 extends forward from the upper surface of the lead-out portion 854.

The retainer 865 is made of synthetic resin and mounted on the front side of the housing 840. The retainer 865 is assembled with the housing 840 by locking a locking projection 867 of the retainer 856 into a locking recess 843 formed in the outer surface of the housing 840. In a state assembled with the housing 840, the retainer 865 has a front wall 868 for stopping the terminals 825 in front. Further, a front end side of the retainer 865 is open so that the male terminals 811 are insertable.

Sample 9

Since Sample 9 is the same as the connector 70 described as one embodiment, this is not described.

Measurement Method

1. Resonant Frequency Measurement Method

A resonant frequency of a connector was measured as follows. A male connector including a male receptacle open in a connecting direction and a female connector including a housing to be fit to the male connector were connected along the connecting direction. With the male connector and the female connector connected, one hour aging was performed in a constant temperature chamber or constant temperature bath regulated to a test temperature. The test temperature was set at 25° C. for Samples 1 to 7 and 9 and at 120° C. only for Sample 8. One of the male connector and the female connector was fixed to a connector fixing portion provided on a vibrating table and wires drawn out from the other connector were fixed to a wire fixing portion provided on the vibrating table. By vibrating the vibrating table at a predetermined frequency in a direction perpendicular to the connecting direction of the connector, vibration was applied to the one connector and the wires drawn out from the other connector. A displacement amount of the other connector was measured using a laser displacement meter. A frequency at which a displacement response magnification between the male connector and the female connector was two-fold or higher and the phase of the vibration applied by the vibrating table and the phase of the displacement measured by the laser displacement meter were shifted by $\pi/2$ was assumed as a connector resonant frequency. The predetermined frequency was set at 500 Hz to 2000 Hz.

2. Rigidity Measurement Method

The rigidity of the connector in a state where the male connector and the female connector were connected was measured as follows. The male connector including the male receptacle open in the connecting direction and the female connector including the housing to be fit to the male connector were connected along the connecting direction. With the male connector and the female connector connected, one hour aging was performed in the constant temperature chamber or constant temperature bath regulated to a test temperature. The test temperature was set at 25° C. for Samples 1 to 7 and 9 and at 120° C. only for Sample 8. One of the male connector and the female connector was fixed to the connector fixing portion. A tool disposed on a load cell at a position of the other connector near an end part opposite to the connector fixing portion in the connecting direction was pressed at a predetermined test speed in a direction perpendicular to the connecting direction. A rigidity k of the connector in the state where the male connector and the female connector were connected was calculated from a gradient of a resilient deformation region of a load-displacement curve (F-S curve) obtained at this time. The predetermined test speed was set at 1 mm/min.

Results and Considerations

For Samples 1 to 9, the resonant frequency and the rigidity were measured by the above methods. Measurement results were compiled in the form of a table in FIG. 42. Further, a value of the rigidity k of the connector in relation to a mass m of the connector was compiled in the form of a graph in FIG. 43.

In this embodiment, Samples 1, 2, 5 and 8 are comparative examples and Samples 3, 4, 6, 7 and 9 are examples.

It is effective as an anti-vibration measure of a connector to suppress a relative displacement between a male connector and a female connector. One such method is thought to be a method for increasing a resonant frequency of the connector and suppressing a relative displacement by enhancing the rigidity of the connector in a state where the male connector and the female connector are connected.

A relationship of the rigidity k of the connector, the resonant frequency f of the connector and the relative displacement x between the male connector and the female connector is described below.

The following relationship holds between the resonant frequency f of the connector and the relative displacement x between the male connector and the female connector when a denotes a vibration acceleration.

$$x=a/(2\pi f)^2 \quad \text{(Equation 1)}$$

Further, the following relationship generally holds between a natural frequency $\omega=2\pi f$, which is a frequency at which resonance occurs, and the rigidity k when m denotes a mass.

$$\omega(k/m)^{1/2} \quad \text{(Equation 2)}$$

With reference to both Equations 1 and 2, it is clear that the natural frequency w increases and the resonant frequency f of the connector also increases if the rigidity k of the connector is enhanced. As a result, the relative displacement x between the male connector and the female connector can be suppressed.

For example, a case is assumed where a very large acceleration of 100 G is applied to the connector. In this case, if the resonant frequency f of the connector reaches 1600 Hz or higher, the relative displacement x between the male connector and the female connector has a very small value of 1 μm or less. Thus, a sufficient vibration resistance can be obtained.

Figure 43:
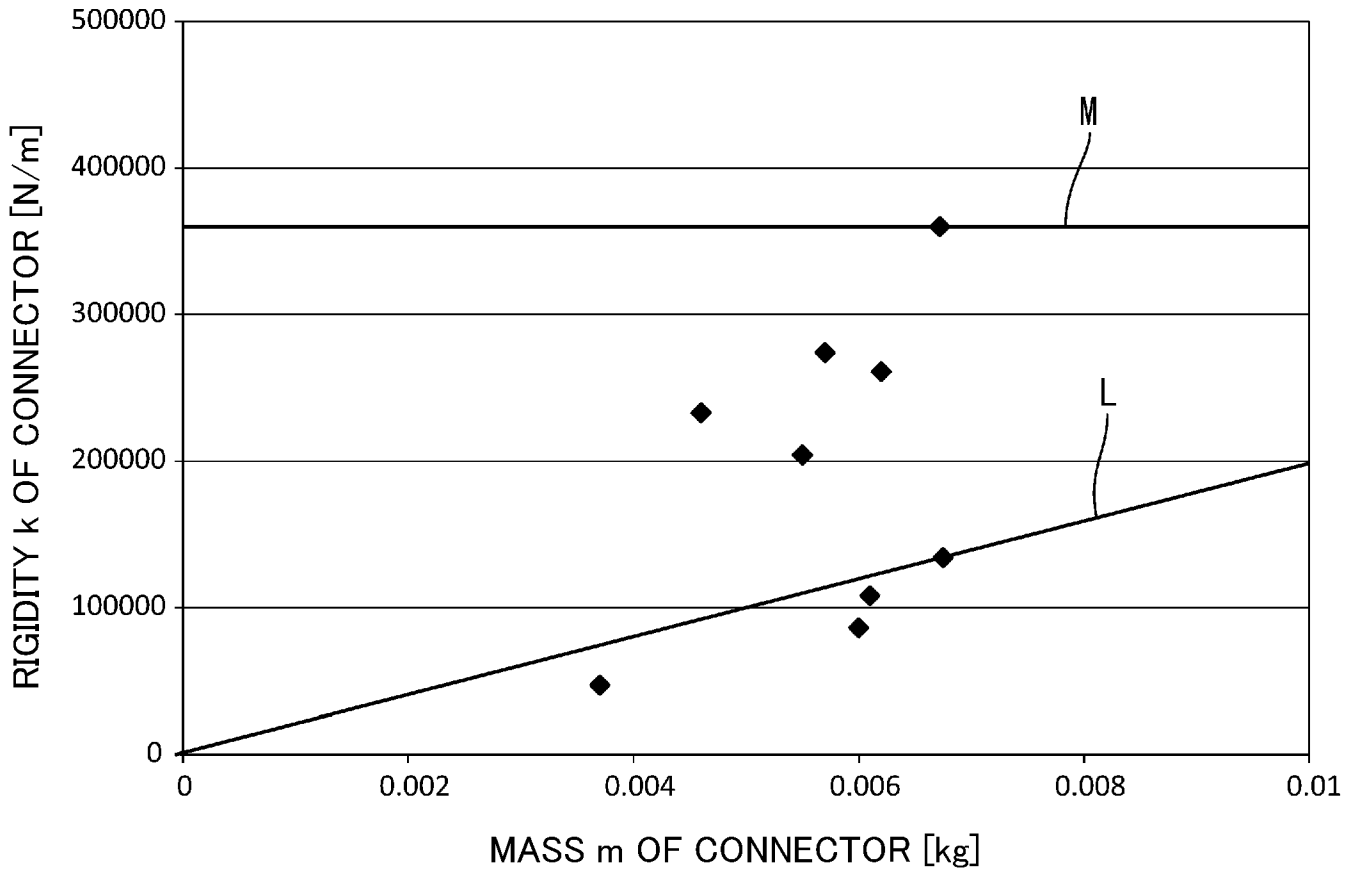
FIG. 43 is a graph showing a value of rigidity k of a connector in relation to a mass m of the connector.

As shown in FIG. 43, it was revealed that Samples 3, 4, 5, 6, 7 and 9 having a resonant frequency of 1600 Hz or higher had a value of k larger than a straight line L expressed by:

$$k=(2.0\times10^7)\times m$$

for the rigidity k of the connector and the mass m of the connector. As a result, to obtain a connector having a sufficient vibration resistance, the rigidity k and the mass m of the connector need to have a relationship expressed by the following equation.

$$k\geq(2.0\times10^7)\times m$$

Note that the resonant frequency f of the connector is preferably 1600 Hz or higher, more preferably 1900 Hz or higher, even more preferably 1950 Hz or higher and particularly more preferably 2000 Hz or higher.

On the other hand, if a clearance between the male connector and the female connector is made smaller to enhance the rigidity k of the connector, a connection force of the male connector and the female connector increases. Then, the efficiency of a connecting operation of the male connector and the female connector is reduced. Accordingly, the rigidity k of the connector in the state where the male connector and the female connector are connected is preferably less than 360000 [N/m], exclusive of 360000 [N/m], (see straight line M). The rigidity k is more preferably 34000 [N/m] to 274000 [N/m], even more preferably 204000 [N/m] to 261000 [N/m] and particularly more preferably 233000 [N/m].

Functions and Effects of Embodiment

Next, functions and effects of this embodiment are described. The connector according to this embodiment is a connector with the male connector including the receptacle open in the connecting direction and the female connector including the housing to be fit to the male connector along the connecting direction. With the male connector and the female connector connected, one of the male connector and the female connector is fixed, and the rigidity k [N/m] satisfies k<360000 when the other connector is loaded at a test speed of 1 mm/min in the direction perpendicular to the connecting direction and satisfies k $(2.0\times10^7)\times$m, where m [kg] denotes the mass of the other connector.

Since the rigidity k is less than 360000 [N/m], exclusive of 360000 [N/m], according to this embodiment, a reduction in the efficiency of the connecting operation of the male connector and the female connector can be suppressed.

Further, according to this embodiment, the following relational expression is satisfied if the mass of the female connector is m [kg].

$$k(2.0\times10^7)\times m$$

According to the above configuration, since the resonant frequency f in the state where the male connector and the female connector are connected is 1600 Hz or higher, a sufficient vibration resistance can be provided.

Further, the female connector 20 includes the housing 40 for holding the terminals 25 connected to the end parts of the wires 22, and the housing 40 includes the lead-out portion 54 from which the wires 22 connected to the terminals 25 are led out to outside, the protruding portion 46 protruding outward to face the tip part of the receptacle 13, the external fitting portion 50 projecting from the protruding portion 46 toward the receptacle 13 to be externally fit to the tip part of the receptacle 3 and exposing the outer surface of the base end side of the receptacle 13, and the reinforcing ribs 60A, 60B connected to the lead-out portion 54 and the protruding portion 46.

According to this embodiment, since the external fitting portion 50 of the housing 40 is formed to be externally fit to the tip part of the receptacle 13 and expose the outer surface of the base end side of the receptacle 13, the female connector 20 can be reduced in weight as compared to a configuration in which the external fitting portion 50 is also externally fit to the outer surface of the base end side of the receptacle 13. Since the resonant frequency changes and the influence of the resonance of the female connector 20 can be suppressed if the female connector 20 is reduced in weight, it is possible to suppress troubles caused by vibration while reducing manufacturing cost. Here, if the female connector 20 is reduced in weight, the rigidity of the housing 40 tends to decrease and a displacement amount of the female connector 20 with respect to the male connector 10 becomes larger due to the vibration of the wires 22. Thus, there is a concern for troubles such as sliding wear in a part where the terminals 11, 25 are in contact with each other due to a positional deviation of the terminal 25 or the like. Since the protruding portion 46 and the lead-out portion 54 are connected by the reinforcing ribs 60A, 60B according to this embodiment, the rigidity of the housing 40 is enhanced by the reinforcing ribs 60A, 60B and a reduction in the rigidity of the housing 40 and troubles due to an increase in the displacement amount of the female connector 20 can be suppressed.

Further, the plurality of terminals 25 connected to the plurality of wires 22 are provided, the plurality of wires 22 are led out from the lead-out portion 54 and the reinforcing ribs 60A, 60B extend in the direction perpendicular to (intersecting) an arrangement direction of the plurality of wires 22. If the wire 22 vibrates, the lead-out portion 54 is more easily vibrated in the direction intersecting the arrangement direction of the wires 22 than in the arrangement direction of the wires 22. In such a direction that vibration easily occurs, troubles by vibration can be suppressed by the reinforcing ribs 60A, 60B.

Further, the protruding portion 46 includes the thick portion 47 having an increased thickness, and the reinforcing ribs 60A, 60B are connected to the thick portion 47. In this manner, the strengths of connecting parts of the protruding portion 46 and the reinforcing ribs 60A, 60B can be enhanced by the thick portion 47. Therefore, troubles due to the deformation of the housing 40 can be suppressed.

Other Embodiments

The technique disclosed in this specification is not limited to the above described and illustrated embodiment. For example, the following embodiment is also included in the technical scope of the technique disclosed in this specification.

(1) The female connector may be fixed and the rigidity when a load is applied to the male connector at a test speed of 1 mm/min may be measured.

The invention claimed is:

1. A connector, comprising a male connector; and a female connector including a housing to be fit to the male connector along a connecting direction, wherein:

the connector has a rigidity k [N/m] that is measured in a state in which the male connector and the female connector are connected to each other along the connecting direction, while a first connector, which is one of the male connector and the female connector is fixed and a second connector, which is another of the male connector and the female connector, is distorted at a test speed of 1 mm/min in a direction intersecting the connecting direction, and the measured rigidity k [N/m] satisfies $k<360000$ and satisfies $k\geq(2.0\times10^{7})\times m$, where m [kg] denotes a mass of the second connector.

2. The connector of claim 1, wherein the second connector is the female connector.

3. The connector of claim 1, wherein:

the male connector includes a receptacle to be fit to the housing, a terminal connected to an end of a wire is held in the housing, and the housing includes:

a lead-out from which the wire connected to the terminal is led out to outside;

a protrusion protruding outward to face a tip of the receptacle;

an external fitting projecting from the protrusion toward the receptacle to be externally fit to the tip of the receptacle and exposing an outer surface of a base end side of the receptacle; and a reinforcing rib connected to the lead-out and the protrusion.

4. The connector of claim 1, wherein the housing of the female connector includes a plurality of insertion holes penetrating in a front-rear direction of the housing which is the connecting direction, and a plurality of terminal-provided wires being respectively inserted into the plurality insertion holes.

* * * * *